US006982525B2

(12) United States Patent
Mun et al.

(10) Patent No.: US 6,982,525 B2
(45) Date of Patent: Jan. 3, 2006

(54) PLASMA DISPLAY

(75) Inventors: Byung Jun Mun, Daegu (KR); Yong Song, Kumi-shi (KR); Byung Ho Rhee, Chungcheongnam-do (KR)

(73) Assignee: LG Electronics Inc., Seoul (KR)

( * ) Notice: Subject to any disclaimer, the term of this patent is extended or adjusted under 35 U.S.C. 154(b) by 146 days.

(21) Appl. No.: 10/739,205

(22) Filed: Dec. 19, 2003

(65) Prior Publication Data

US 2004/0130268 A1 Jul. 8, 2004

(30) Foreign Application Priority Data

Dec. 20, 2002 (KR) ..... 10-2002-0081944
Dec. 30, 2002 (KR) ..... 10-2002-0087092

(51) Int. Cl.
*H01J 17/49* (2006.01)

(52) U.S. Cl. ..... 313/582; 313/584

(58) Field of Classification Search ..... 313/582, 313/584, 585, 491, 631
See application file for complete search history.

(56) References Cited

U.S. PATENT DOCUMENTS 6,646,377 B2 * 11/2003 Hashimoto ..... 313/582

FOREIGN PATENT DOCUMENTS

| | | |
|---|---|---|
| JP | 2002075213 | 3/2002 |
| KR | 1019990056759 | 7/1999 |

* cited by examiner

*Primary Examiner*—Vip Patel
(74) *Attorney, Agent, or Firm*—Fleshner & Kim, LLP

(57) ABSTRACT

A plasma display is adaptive for improving brightness and discharge efficiency. In the plasma display, a pair of transparent electrodes is formed in opposing relation to each other and having a predetermined gap within a discharge cell. A metal electrode is connected to each transparent electrode in the pair. The gap is formed in a diagonal direction within the discharge cell.

26 Claims, 24 Drawing Sheets

PLASMA DISPLAY

BACKGROUND OF THE INVENTION

1. Field of the Invention

This invention generally relates to a plasma display, and more particularly to a plasma display that is adaptive for improving brightness as well as discharge efficiency.

2. Description of the Related Art

Recently, a plasma display feasible to a manufacturing of a large-dimension panel has been highlighted as a flat panel display device. The plasma display usually controls a discharge period of each pixel in accordance with a digital video data to thereby display a picture. The plasma display typically includes a three-electrode, alternating current (AC) type plasma display that has three electrodes and is driven with an AC voltage.

FIG. 1 shows the manner in which each discharge cell is arranged in a related-art matrix-type, AC-type plasma display. This discharge cell includes an upper plate provided with a sustain electrode pair 14 and 16, an upper dielectric layer 18 and a protective film 20 that are sequentially formed on an upper substrate 10, and a lower plate provided with a data electrode 22, a lower dielectric layer 24, barrier ribs 26 and a phosphorous material layer 28 that are sequentially formed on a lower substrate 18. The upper substrate 10 and the lower substrate 18 are spaced in parallel by the barrier ribs 24.

Each electrode of the sustain electrode pair 14 and 16 is comprised of transparent electrodes 14A and 16A having a relatively large width and made from a transparent electrode material (e.g., ITO) to transmit a visible light, and metal electrodes 14B and 16B having a relatively small width to compensate for a resistance component of the transparent electrodes 14A and 16A. Such a sustain electrode pair 14 and 16 consists of a scan electrode and a sustain electrode. The scan electrode 14 is mainly supplied with a scan signal for panel scanning and a sustain signal for discharge sustaining. The sustain electrode 16 is mainly supplied with a sustain signal. Electric charges are accumulated in the upper and lower dielectric layers 18 and 24. The protective film 20 prevents a damage of the upper dielectric layer 18 caused by sputtering to thereby prolong the lifetime of the plasma display as well as to improve the emission efficiency of secondary electrons. This protective film 20 is usually made from MgO.

The address electrode 22 crosses the sustain electrode pair 14 and 16. This address electrode is supplied with a data signal for selecting discharge cells to be displayed. The barrier ribs are formed in parallel to the address electrode to thereby prevent an ultraviolet ray generated by the discharge from being leaked into adjacent discharge cells. The phosphorous material layer 28 is coated on the surfaces of the lower dielectric layer 24 and the barrier ribs to generate any one of red, green and blue visible lights. A discharge space is filled with an inactive gas for a gas discharge.

The discharge cell of the related-art plasma display having the aforementioned structure selects a discharge cell by an opposite discharge between the address electrode 22 and the scan electrode 14, and thereafter sustains discharge by a surface discharge between the sustain electrode pair 14 and 16. In the discharge cell, the phosphorous material layer is radiated by an ultraviolet ray generated upon sustain discharge to thereby emit a visible light from the cell. In this case, the plasma display controls a discharge sustain period, that is, a sustain discharge frequency of the discharge cell, in accordance with video data to thereby implement a gray scale required for an image display.

Such an AC surface-discharge plasma display makes a time-divisional driving of one frame, which is divided into a plurality of sub-fields, so as to realize gray levels of a picture. A light-emission having a frequency proportional to a weighting value of video data is made in each sub-field period to thereby express a gray level. For instance, if it is intended to display a picture of 256 gray levels using an 8-bit video data, one frame display interval (i.e., 1/60 second=about 16.7 msec) at each discharge cell 11 is divided into 8 sub-fields SF1 to SF8. Each of the 8 sub-fields SF1 to SF8 again is divided into a reset period, an address period and a sustain period, and the sustain period is given by a weighting value at a ratio of 1:2:4:8, . . . ,:128. Herein, the reset period is a period for initializing the discharge cell, the address period is a period for generating a selective address discharge in accordance with a logical value of video data, and the sustain period is a period for sustaining discharge at the discharge cell where the address discharge is generated. The reset period and address period are identically assigned in each sub-field interval.

If electrode widths of the scan electrode 14 and the sustain electrode 16 are formed narrowly in order to reduce power consumption of the plasma display, then a discharge path upon discharge is shortened to thereby limit an light-emission area. Thus, the amount of ultraviolet ray emission is reduced and hence brightness is deteriorated. Further, discharge at the discharge cell is generated in a manner diffused into a gap between the respective transparent electrodes 14A and 16A of the sustain electrode pair 14 and 16; that is, in a manner diffused from the center of the discharge cell into the ends of the transparent electrodes 14A and 16A. Accordingly, if it goes far away from the gap between the transparent electrodes 14A and 16A, then discharge efficiency is reduced and brightness also is reduced.

FIG. 2 shows a plasma display having a different electrode structure that includes projecting electrodes. In this plasma display, a sustain electrode pair 44 and 46 consists of stripe-type metal electrodes 44A and 46A formed in a stripe type and projecting electrodes 44B and 46B formed within the discharge cell and connected to the respective metal electrodes 44A and 46A.

The metal electrodes 44A and 46A are positioned at each edge of the discharge cell and are made from a metal material having good conductivity such as sliver (Ag) or copper (Cu). The projecting electrodes 44B and 46B have a relatively larger width than the metal electrodes 44A and 46B and are formed in opposing relation thereto.

In order to reduce the amount of current wasted from such a protrusion-type sustain electrode pair 44 and 46, the projecting electrodes 44B and 46B are formed to have a width (W) of about 200 $\mu$m to 250 $\mu$m and a length (L) of about 400 $\mu$m to 1000 $\mu$m. However, even though sizes of the projecting electrodes 44B and 46B have been set appropriately, an area occupied by the electrodes is reduced and hence a discharge voltage is increased, thereby causing a deterioration of discharge efficiency.

In order to overcome problems caused by the protrusion-type projecting electrode, a plasma display including T-type projecting electrodes has been proposed as shown in FIG. 3. In this plasma display, a sustain electrode pair 54 and 56 formed on an upper substrate (not shown) are comprised of stripe-type metal electrodes 54A and 56A and T-type projecting electrodes 54B and 56B which protrude from the metal electrodes 54A and 56A, respectively.

The T-type projecting electrodes 54B and 56B extend from the metal electrodes 54A and 56A and are opposed to each other in a T shape. The first electrode width W1 of the T-type projecting electrodes 54B and 56B is formed to be smaller than the second electrode width W2 thereof. Since the electrode width W2 at an opposite portion of the two T-type projecting electrodes 54B and 56B is large, it is not difficult to cause a discharge. Thus, even though the first electrode width W1 is small, brightness is not reduced largely and an area occupied by the electrodes is reduced to thereby decrease a wasted current amount.

However, in the plasma display including T-type projecting electrodes modifying the protrusion type, a distance W3 between the projecting electrodes 54B and 56B at each side and the barrier ribs 58 is not equal when a mis-alignment occurs upon joint of the substrates. An amount of absorbed electric charges is increased more, as it is closer to the barrier ribs 58. Thus, if a distance W3 between each side surface of the projecting electrodes 54B and 56B becomes different, then an amount of wall charges produced at each side upon discharge is differentiated.

FIG. 4 shows a plasma display which includes a transparent blank-type electrode, which is another electrode structure which has been proposed for plasma displays. This plasma display is comprised of transparent electrodes 34A and 36A having holes formed on an upper substrate, and metal electrodes 34B and 36B for compensating for resistance components of the transparent electrodes 34A and 36A.

The transparent electrodes 34A and 36A have a relatively large width and are made from a transparent electrode material such as ITO for the purpose of transmitting visible light. A hole 35 may be formed in a square shape or various polygonal shapes. Since holes 35 are formed at transparent electrodes 34A and 36A, an area of the transparent electrodes 34A and 36A are reduced. Accordingly, a capacitance value is reduced and hence power consumption is reduced. Also, an electrode area of the sustain electrode pair 34 and 36 is reduced, thereby increasing an aperture ratio.

However, the blank-type plasma display including sustain electrode pair 34 and 36 defines holes 35 at the transparent electrodes 34A and 36A to thereby somewhat improve power consumption, but it also raises a discharge-separation phenomenon in which two discharge modes are formed within a driving voltage. More specifically, as shown in FIG. 5, the transparent electrode 36A of the sustain electrode can be divided into A, B and C areas around the hole 35. If a discharge voltage is applied to the transparent electrode 36A, then a discharge is generated at the A area of the transparent electrode 36A positioned at the closest distance and then is diffused into the B and C areas. At this time, if a voltage is dropped within a sustain voltage margin, then an amount of accumulated wall charges becomes small because the B area has a small discharge area, and electric charges absorbs from the barrier rib 38 to thereby increase an amount of lost electric charge because it is positioned at a close distance from the barrier rib 38. Accordingly, the B area makes a small contribution to a plasma discharge, and a short pass discharge is limited to the A area to thereby separate the discharge into the A area and the C area and hence largely reduce brightness.

In the plasma display discharge cell structures described above, as shown in FIG. 6, a strong discharge is generated at the center of the discharge cell while weaker discharge is generated as the distance away from the center increases. Furthermore, a discharge is not generated at the edge area of the discharge cell. Accordingly, the related-art plasma display has problems in that discharge efficiency and brightness are deteriorated.

Also, the related-art plasma display discharge cell structures have a problem in that, because a distance between the metal electrodes is far away from the opposite surface of the transparent electrodes, power consumption caused by a resistance is large. The related-art plasma display discharge cell structures have another problem in that, because a distance between the metal electrodes from the opposite surface of the transparent electrodes is constant to thereby cause an initial discharge at all positions of the opposite surface, efficiency of the initial discharge is deteriorated.

SUMMARY OF THE INVENTION

An object of the present invention is to overcome one or more of the drawbacks described above and/or to achieve at least one or the advantages noted herein.

An object of the present invention to provide a plasma display that is adaptive for improving brightness as well as discharge efficiency.

Another object of the present invention is to provide a plasma display that is adaptive for reducing power consumption.

Another object of the present invention is to provide a plasma display that is adaptive for improving initial discharge efficiency.

In order to achieve these and other objects, the present invention provides a plasma display which according to one embodiment includes a transparent electrode pair formed in such a manner to be opposed to each other with having a predetermined distance of a gap within a discharge cell, and a metal electrode connected to each of the transparent electrode pair, wherein the gap is formed in a diagonal direction within the discharge cell. The transparent electrode pair is preferably formed in a triangular shape shape within the discharge cell, and the transparent electrode has an inclined plane in a range of 0° to 90°. The inclined planes are in opposing relation to each other in such a manner to have the gap in a diagonal direction within the discharge cell. The inclined plane is also preferably formed in stepwise or curved shape. The plasma display further includes a plurality of holes formed in the transparent electrode.

Alternatively, the transparent electrode pair is spaced at a predetermined distance from the barrier rib and is formed in a triangular shape shape within the discharge cell in such a manner to have said gap. The transparent electrode has an inclined plane in a range of 0° to 90°, and the inclined planes are in opposing relation to each other in such a manner to have the gap in a diagonal direction within the discharge cell. The inclined plane is also preferably formed in a stepwise and a curved shape. The plasma display further includes a plurality of holes formed in the transparent electrode.

Alternatively, the transparent electrode includes a neck portion connected to the metal electrode, and a head portion formed in a triangular shape shape from the neck portion. The head portion has an inclined plane in a range of 0° to 90°. One side of head portion preferably connected to the neck portion has a larger width than the neck portion while other side thereof has a decreasing width to have the inclined plane from the one side thereof. The inclined planes are in opposing relation to each other in such a manner to have the gap in a diagonal direction within the discharge cell.

The inclined plane is also preferably formed in a stepwise or curved shape. The plasma display further includes a plurality of holes formed in the head portion.

Alternatively, the transparent electrode pair includes a first transparent electrode and a second transparent electrode, and wherein each of the first and the second transparent electrodes has a stripe portion connected in such a manner to cross the metal electrode and a head portion formed in a triangular shape in such a manner to have the gap from the stripe portion. Herein, an apex of the head portion in a triangular shape is formed on the barrier rib for separating the adjacent discharge cells. The gap is preferably formed in a zigzag pattern. The plasma display further includes a plurality of holes formed in the head portion.

An apex of the head portion of the first transparent electrode is formed on the barrier rib for separating the adjacent discharge cells, while an apex of the head portion of the second transparent electrode is formed within the discharge cell. The apex of the head portion of the first transparent electrode is formed on the barrier rib in such a manner to have the gap from the stripe portion of second transparent electrode.

The apex of the head portion of the second transparent electrode is formed at the center of the discharge cell in such a manner to have the gap from the stripe portion of first transparent electrode. The gap is preferably formed in a zigzag pattern. The plasma display further includes a plurality of holes formed in the head portion.

DETAILED DESCRIPTION OF THE PREFERRED EMBODIMENT

Figure 7:
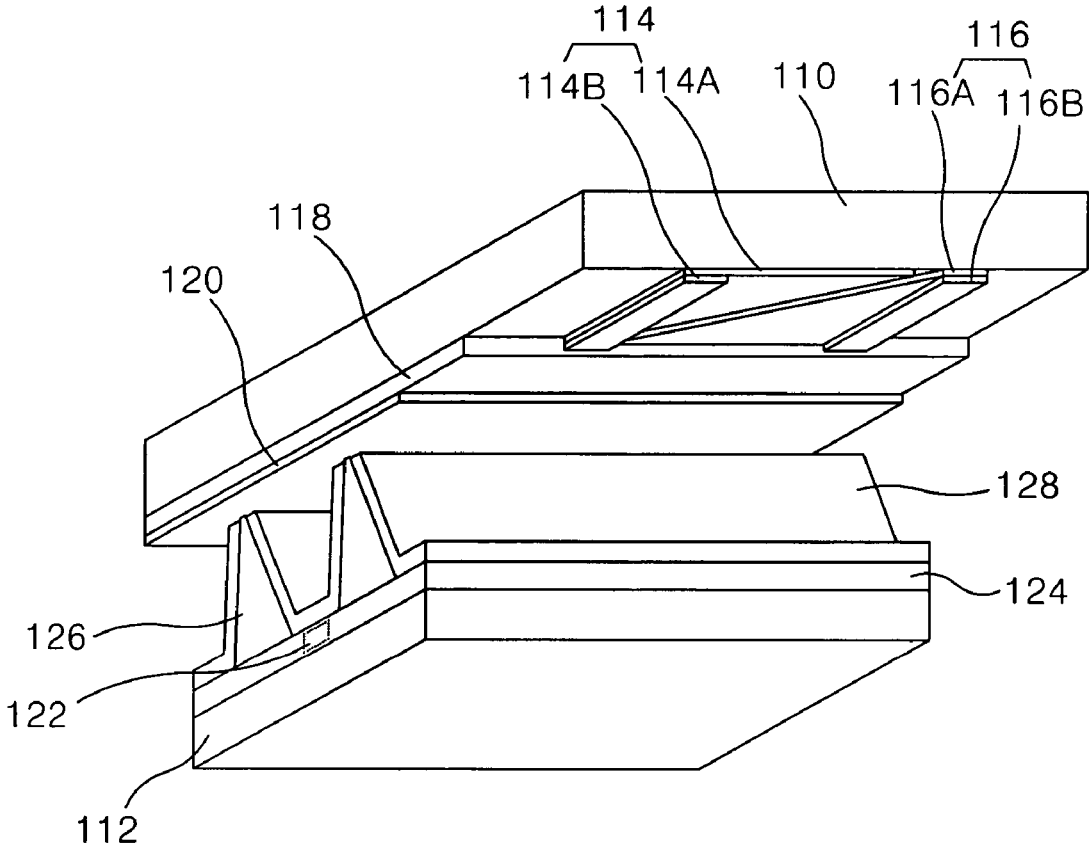
FIG. 7 is a perspective view showing a discharge cell structure of a plasma display according to a first embodiment of the present invention.
Figure 8:
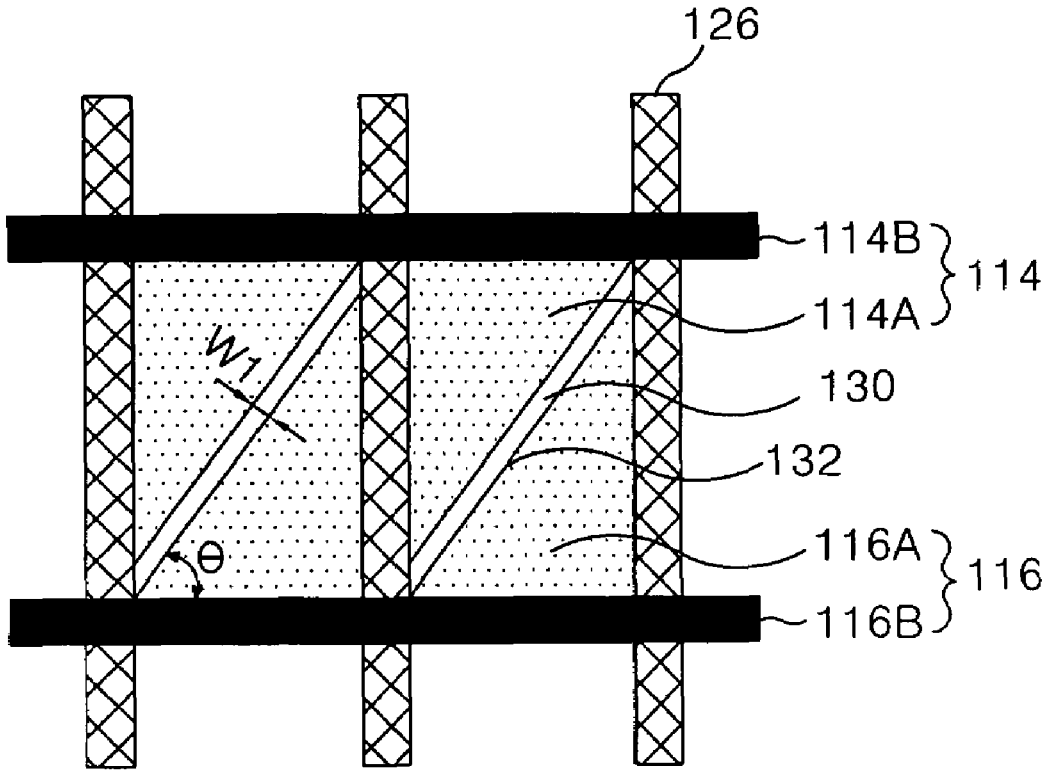
FIG. 8 is a plan view showing an electrode structure of the plasma display in FIG. 7.

Referring to FIG. 7 and FIG. 8, a plasma display according to a first embodiment of the present invention includes an upper plate provided with a sustain electrode pair 114 and 116 having a gap 130 at a predetermined distance W1 in a diagonal line direction, an upper dielectric layer 118 and a protective film 120 that are sequentially formed on an upper substrate 110, and a lower plate provided with an address electrode 122, a lower dielectric layer 124, barrier ribs 126 and a phosphorous material layer 128 that are sequentially formed on a lower substrate 118. The upper substrate and the lower substrate are spaced in parallel by the barrier ribs.

Each electrode of the sustain electrode pair 114 and 116 is comprised of transparent electrodes 114A and 116A formed in a triangular shape having an inclined plane 132 within the discharge cell, and metal electrodes 114B and 116B in a stripe shape formed at one edge of the transparent electrodes 114A and 114B.

Each of the transparent electrodes 114A and 116A is made from a transparent electrode material such as ITO and takes a triangular shape having the inclined plane 132 at a predetermined slope θ in such a manner to be opposed to each other with a gap W1 in a range of 30 μm to 100 μm. In this case, a slope θ of the inclined plane 132 of each of the respective transparent electrodes 114A and 116A has a range of 0° to 90°, and an optimum slope thereof has a range of 0° to 45°. Because the inclined plane 132 has triangular-shape transparent electrodes 114A and 116A, gap 130 having a predetermined distance W1 is formed in a diagonal line direction within the discharge cell. An electric field concentrates on the corner of each transparent electrode 114A and 116A upon discharge to thereby raise a discharge at an edge area of the discharge cell.

The metal electrodes 114B and 116B have a relatively small width and are formed from sliver (Ag) or copper (Cu) having a good electric conductivity, respectively. This compensates for an electric resistance of the transparent electrodes 114A and 116A.

Such a sustain electrode pair 114 and 116 consists of a scan electrode and a sustain electrode. The scan electrode 114 is mainly supplied with a scan signal for a panel scanning and a sustain signal for a discharge sustaining. The sustain electrode 116 is mainly supplied with a sustain signal. Electric charges accumulate in the upper and lower dielectric layers 118 and 124. The protective film 120 prevents damage of the upper dielectric layer 118 caused by sputtering to thereby prolong the life of the plasma display, as well as to improve emission efficiency of secondary electrons. This protective film 120 may be made from MgO. The address electrode 122 crosses the sustain electrode pair 114 and 116. This address electrode is supplied with a data signal for selecting discharge cells to be displayed. The barrier ribs are formed in parallel to the address electrode 122 to thereby prevent ultraviolet rays generated by the discharge from leaking into adjacent discharge cells. The phosphorous material layer 128 is coated on the surfaces of the lower dielectric layer 124 and the barrier ribs 126 to generate any one of red, green and blue visible lights. A discharge space is filled with an inactive gas for a gas discharge.

Figure 9:
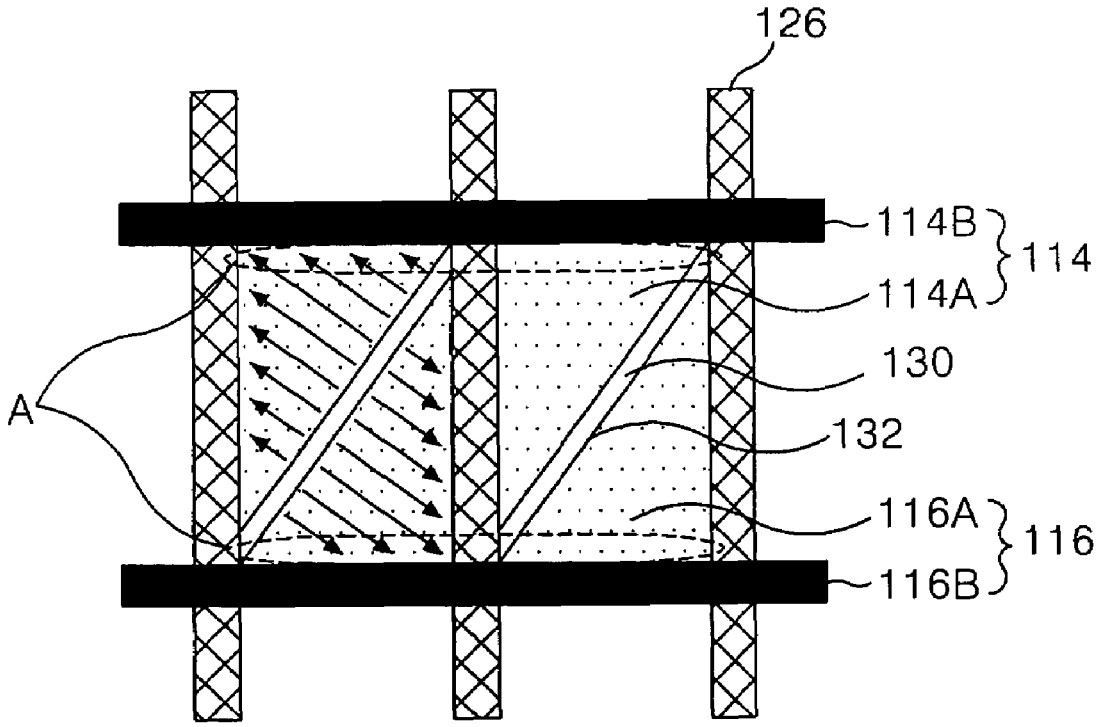
FIG. 9 is a plan view showing a discharge generated at the plasma display in FIG. 8.

In the plasma display according to the first embodiment of the present invention, discharge at the conventional non-discharge area A upon discharge is activated as shown in FIG. 9 with the aid of the gap 130 between the transparent electrodes 114A and 116A formed in a diagonal direction within the discharge cell. This enhances discharge efficiency as well as increases a discharge path upon discharge to enlarge a light-emission area. Accordingly, the plasma display according to the first embodiment of the present invention can increase the amount of ultraviolet rays emitted upon discharge to thereby improve brightness.

Figure 10:
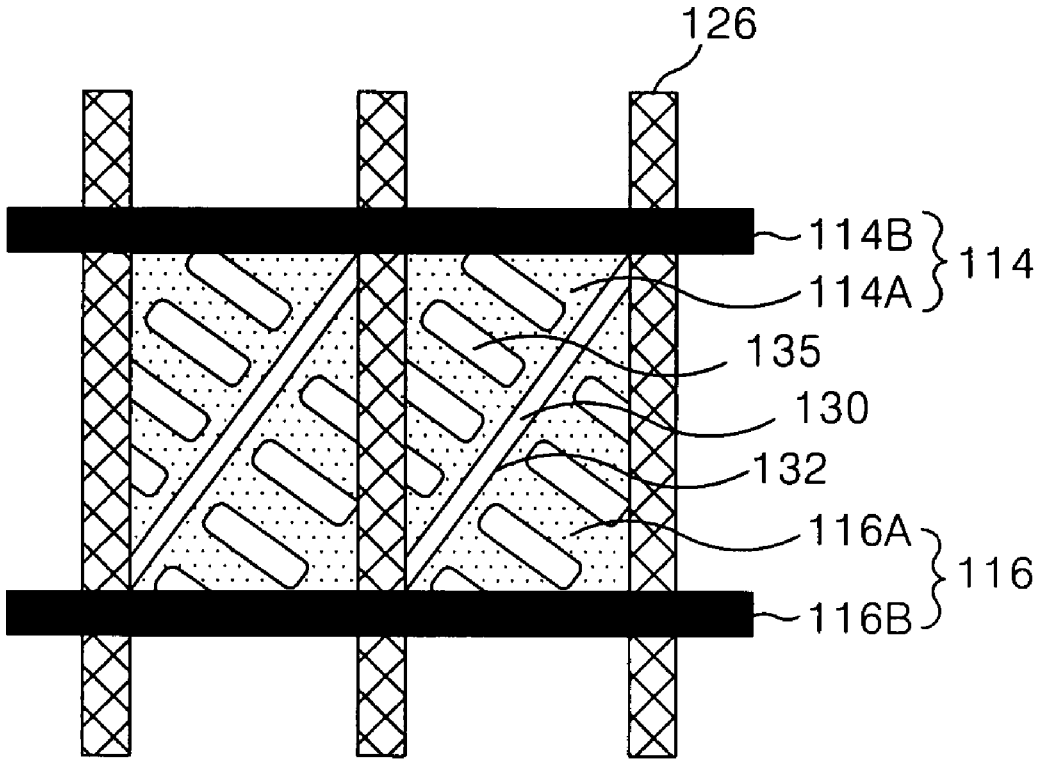
FIG. 10 is a plan view showing an electrode structure of a plasma display according to a second embodiment of the present invention.

Referring to FIG. 10, a plasma display according to a second embodiment of the present invention preferably has the same elements as the plasma display according to the first embodiment except for holes 135 formed at the transparent electrodes 114A and 116A of the plasma display. Accordingly, see the foregoing description for an explanation of these same elements, excluding holes 135 formed at the transparent electrodes 114A and 116A in the plasma display.

Holes 135 are formed in a circular, square, or polygonal shape at the triangular shape transparent electrodes 114A and 116A to thereby reduce an area of the transparent electrodes 114A and 116A. Thus, in the plasma display according to the second embodiment, capacitance values of the transparent electrodes 114A and 116A are reduced and hence power consumption is reduced. Moreover, an electrode area of the sustain electrode pair 114 and 116 can be reduced to thereby increase aperture ratio.

Furthermore, discharge at the non-discharge area upon discharge is activated with the aid of the gap 130 between the transparent electrodes 114A and 116A formed in a diagonal line direction within the discharge cell. This enhances discharge efficiency as well as increasing a discharge path upon discharge to enlarge a light-emission area. Accordingly, the plasma display according to the second embodiment of the present invention can increase the amount of ultraviolet rays emitted upon discharge to thereby improve brightness.

Figure 11:
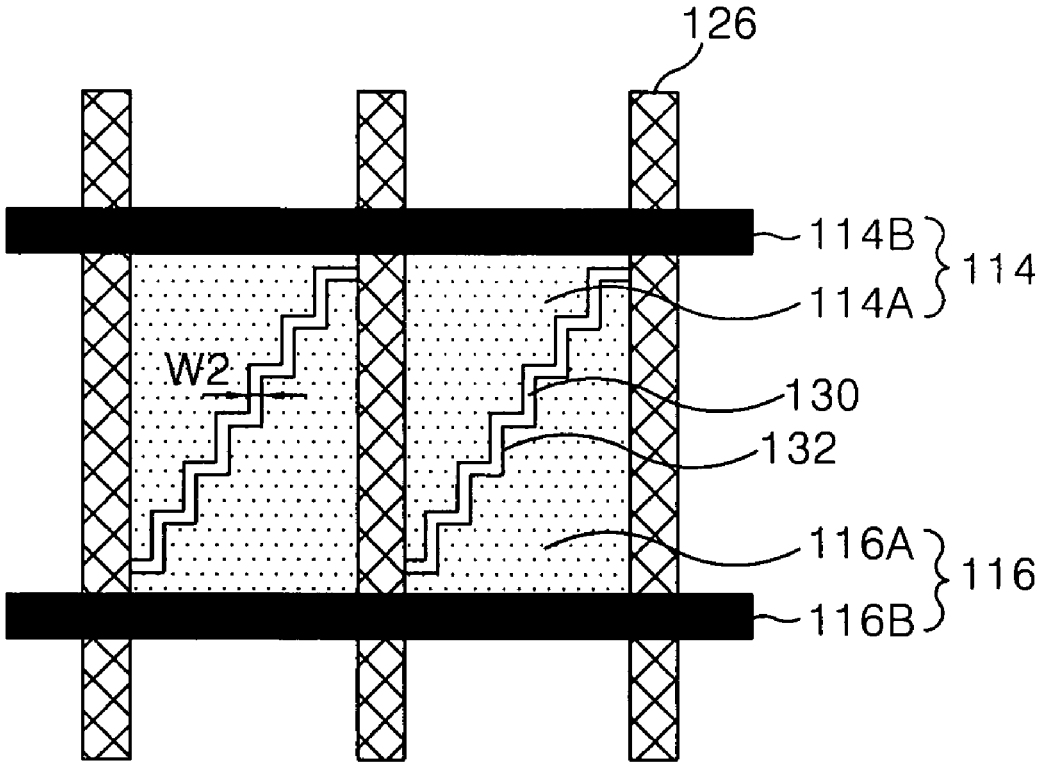
FIG. 11 is a plan view showing an electrode structure of a plasma display according to a third embodiment of the present invention.

Referring to FIG. 11, a plasma display according to a third embodiment of the present invention has the same elements as the plasma display of the first embodiment shown in FIG. 8 except for the shape of the inclined plane 132 of each transparent electrode 114A and 116A opposed to each other in such a manner to have a predetermined gap W2. In this embodiment, transparent electrodes 114A and 116A are formed in a triangular shape in such a manner to have a predetermined gap W2 in a diagonal line direction within the discharge cell. In this case, the inclined plane 132 of each triangular shape transparent electrode 114A and 116A is formed in a stepwise shape. Accordingly, an electric field concentrates on each stepwise corner upon discharge between the transparent electrodes 114A and 116A to thereby raise discharge at the edge area of the discharge cell.

Furthermore, discharge at the non-discharge area upon discharge is activated with the aid of the gap 130 between the transparent electrodes 114A and 116A formed in a diagonal line direction within the discharge cell, thereby enhancing discharge efficiency as well as increasing a discharge path upon discharge to enlarge a light-emission area. Accordingly, the plasma display according to the third embodiment of the present invention can increase the amount of ultraviolet rays emitted upon discharge to thereby improve brightness.

Figure 12:
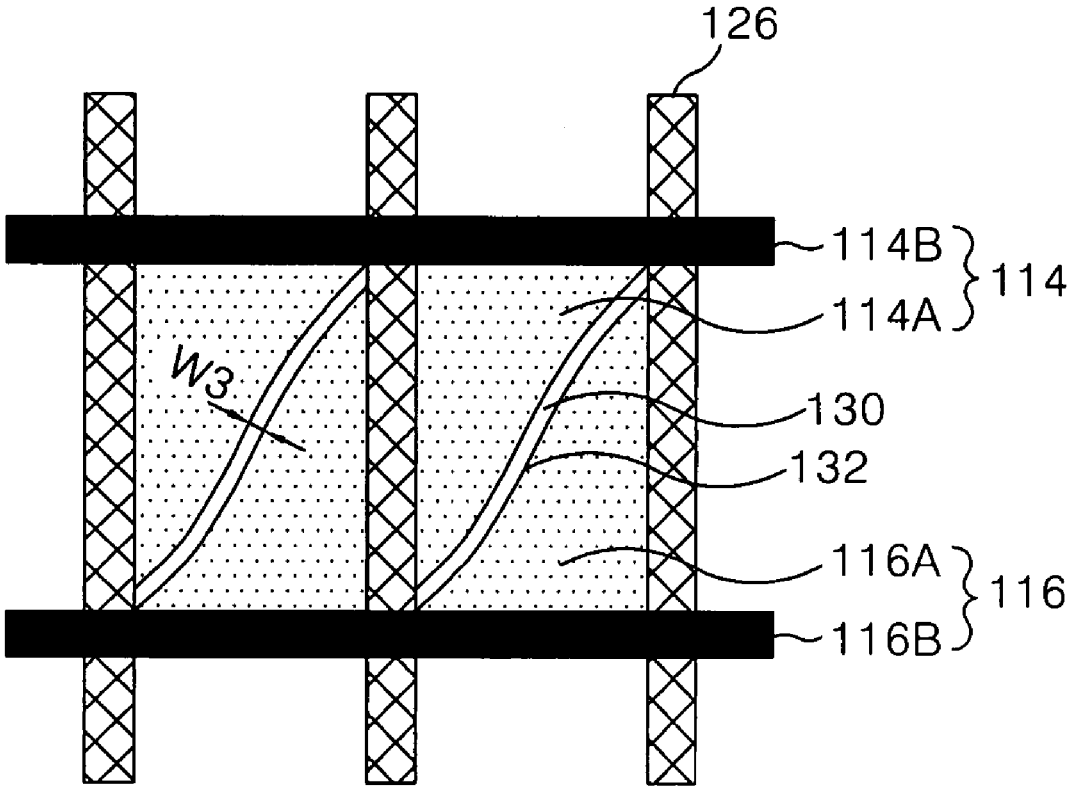
FIG. 12 is a plan view showing an electrode structure of a plasma display according to a fourth embodiment of the present invention.

Referring to FIG. 12, a plasma display according to a fourth embodiment of the present invention has the same elements as the plasma display of the first embodiment shown in FIG. 8 except for the shape of the inclined plane 132 of each transparent electrode 114A and 116A which are opposed to each other in such a manner to have a predetermined gap W3. In this embodiment, transparent electrodes 114A and 116A are formed in a triangular shape in such a manner to have a predetermined gap W3 in a diagonal line direction within the discharge cell. In this case, the inclined plane 132 of each triangular shape transparent electrode 114A and 116A is formed in a curved shape.

In the plasma display according to the fourth embodiment of the present invention, discharge at the non-discharge area upon discharge is activated with the aid of the gap 130 between the transparent electrodes 114A and 116A formed to have a predetermined gap W3 in a diagonal line direction within the discharge cell, thereby enhancing discharge efficiency as well as increasing a discharge path upon discharge to enlarge a light-emission area. Accordingly, the plasma display according to the fourth embodiment of the present invention can increase the amount of ultraviolet rays emitted upon discharge to thereby improve brightness.

Figure 13:
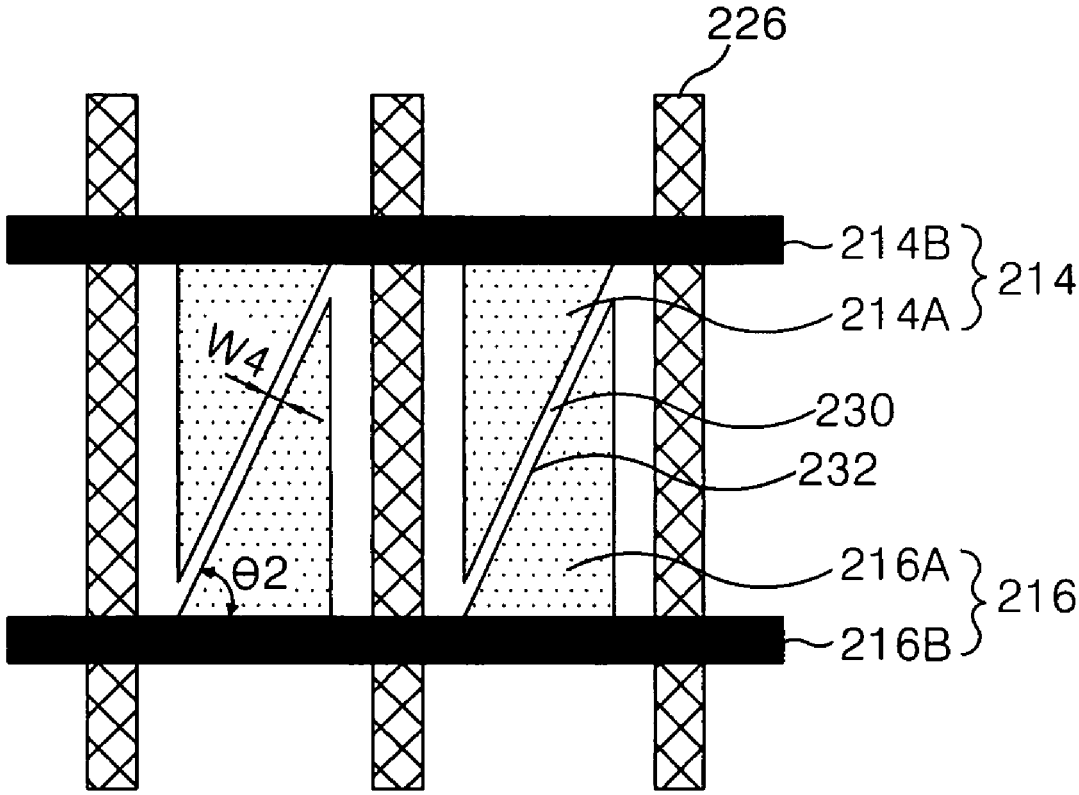
FIG. 13 is a plan view showing an electrode structure of a plasma display according to a fifth embodiment of the present invention.

Referring to FIG. 13, a plasma display according to a fifth embodiment of the present invention has the same elements as the plasma display according to the first embodiment shown in FIG. 7 except for transparent electrodes 214A and 216A. In this embodiment, transparent electrodes 214A and 216A are formed in a right-triangular shape within the discharge cell and are connected to metal electrodes 214B and 216B, respectively.

More specifically, a width of the first transparent electrode 214A decreases as it goes toward the second transparent electrode 216A at one side thereof within the discharge cell, while a width of the second transparent electrode 216A decreases as it goes toward the first transparent electrode 214A at other side thereof within the discharge cell. A vertical plane of each transparent electrode 214A and 216A is spaced at a predetermined distance from the barrier rib 226 for separating the discharge cell. An inclined plane 232 of each triangular shape transparent electrode 214A and 216A is opposed to each other in such a manner to have a predetermined gap W4 in a diagonal line direction within the discharge cell. In this case, a slope θ2 of the inclined plane 232 of each transparent electrode 214A and 216A has a range of 0° to 90°, and an optimum slope θ2 thereof has a range of 0° to 45°. Because of the inclined planes 232 of the triangular shape transparent electrodes 214A and 216A, the gap 230 having a predetermined distance W4 is formed in a diagonal line direction within the discharge cell. An electric field concentrates on the corner of each transparent electrode 214A and 216A upon discharge to thereby raise a discharge at an edge area of the discharge cell.

In the plasma display according to the fifth embodiment of the present invention, a discharge at the non-discharge area upon discharge is activated with the aid of the gap 230 between the transparent electrodes 214A and 216A formed to have a predetermined gap W4 in a diagonal line direction within the discharge cell, thereby enhancing discharge efficiency as well as increasing a discharge path upon discharge to enlarge a light-emission area. Also, the plasma display according to the fifth embodiment of the present invention can reduce an area of the transparent electrodes 214A and 216A to thereby reduce power consumption because vertical planes of the transparent electrodes 214A and 216A are formed within the discharge cell in such a manner to be spaced at a predetermined distance from the barrier rib 226.

Figure 14:
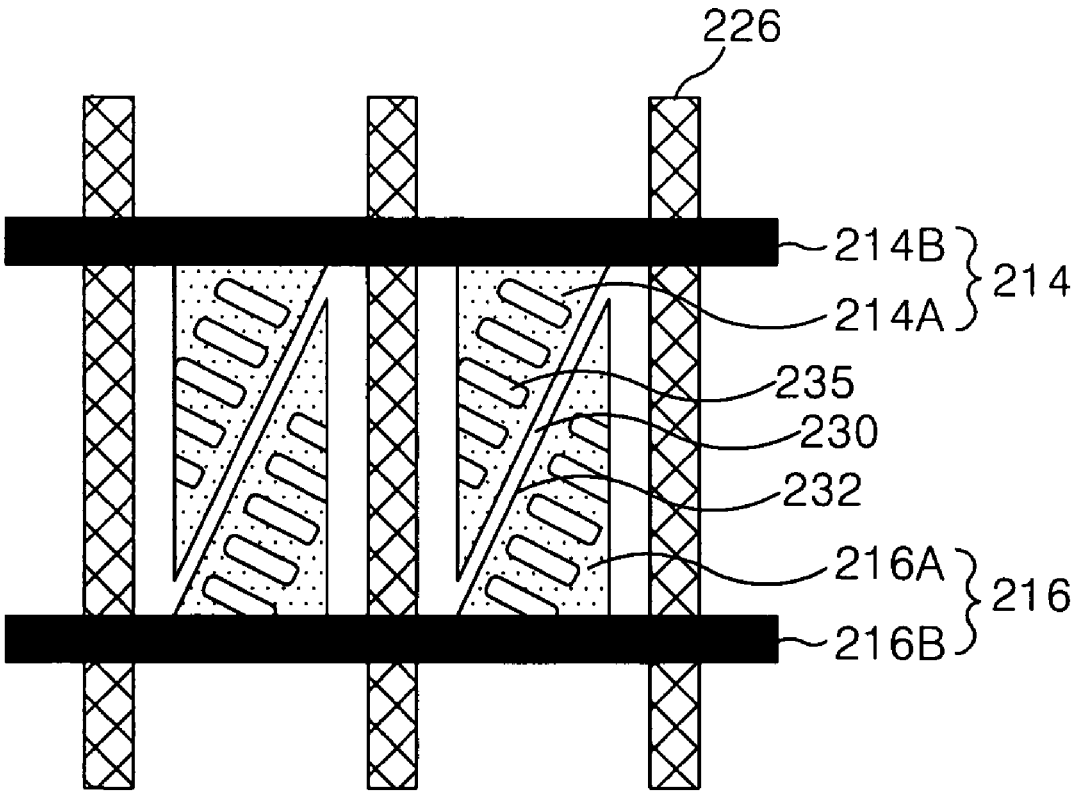
FIG. 14 is a plan view showing an electrode structure of a plasma display according to a sixth embodiment of the present invention.

Referring to FIG. 14, a plasma display according to a sixth embodiment of the present invention has the same elements as the plasma display according to the fifth embodiment shown in FIG. 7, except for holes 235 formed at transparent electrodes 214A and 216A. Holes 235 are formed in a circular, square or polygonal shape at the triangular shape transparent electrodes 214A and 216A to thereby reduce an area of the transparent electrodes 214A and 216A. Thus, capacitance values of the transparent electrodes 214A and 216A are reduced and hence power consumption is reduced. Moreover, in the plasma display according to the sixth embodiment of the present invention, an electrode area of the sustain electrode pair 214 and 216 can be reduced to thereby increase an aperture ratio.

Furthermore, a discharge path is increased to thereby enlarge a light-emission area with the aid of the gap 230 between the transparent electrodes 214A and 216A formed to have a predetermined gap W4 in a diagonal direction within the discharge cell, thereby enhancing discharge efficiency as well as increasing an emission amount of ultraviolet rays upon discharge to improve brightness. Also, the plasma display according to the sixth embodiment of the present invention can reduce an area of the transparent electrodes 214A and 216A to thereby reduce power consumption because vertical planes of the transparent electrodes 214A and 216A are formed within the discharge cell in such a manner to be spaced at a predetermined distance from the barrier rib 226.

Figure 15:
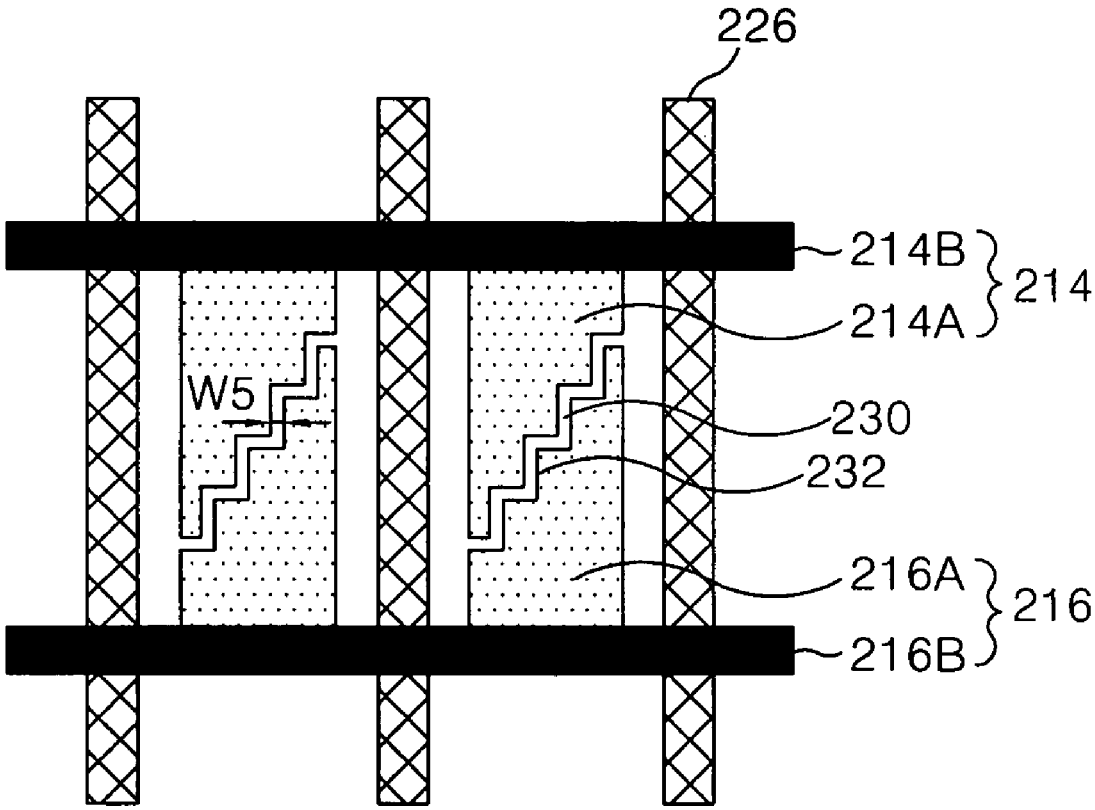
FIG. 15 is a plan view showing an electrode structure of a plasma display according to a seventh embodiment of the present invention.

Referring to FIG. 15, a plasma display according to a seventh embodiment of the present invention has the same elements as the plasma display according to the fifth embodiment shown in FIG. 13 except for a shape of the inclined plane 232 of each transparent electrode 214A and 216A opposed to each other in such a manner to have a predetermined gap W5. In this embodiment, transparent electrodes 214A and 216A are formed in a triangular shape in such a manner to have a predetermined gap W5 in a diagonal line direction within the discharge cell. In this case, the inclined plane 232 of each triangular shape transparent electrode 214A and 216A is formed in a stepwise shape. Accordingly, an electric field concentrates on each stepwise corner upon discharge between the transparent electrodes 214A and 216A to thereby raise a discharge at the edge area of the discharge cell.

In the plasma display according to the seventh embodiment of the present invention, a discharge path is increased to thereby enlarge a light-emission area with the aid of the gap 230 between the transparent electrodes 214A and 216A formed to have a predetermined gap W5 in a diagonal line direction within the discharge cell, thereby enhancing discharge efficiency as well as increasing the amount of ultraviolet rays emitted upon discharge to improve brightness. Furthermore, this plasma display can reduce an area of the transparent electrodes 214A and 216A to thereby reduce power consumption, because vertical planes of the transparent electrodes 214A and 216A are formed within the discharge cell in such a manner to be spaced at a predetermined distance from the barrier rib 226.

Figure 16:
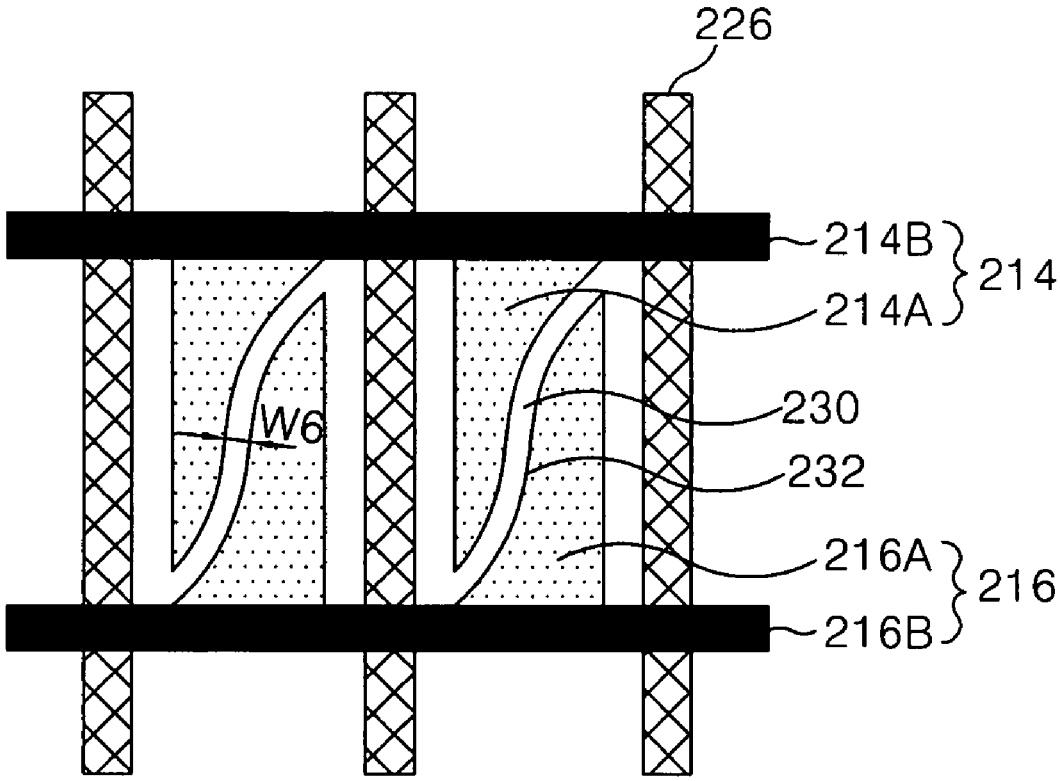
FIG. 16 is a plan view showing an electrode structure of a plasma display according to an eighth embodiment of the present invention.

Referring to FIG. 16, a plasma display according to an eighth embodiment of the present invention has the same elements as the plasma display according to the fifth embodiment shown in FIG. 13, except for a shape of the inclined plane 232 of each transparent electrode 214A and 216A opposed to each other in such a manner to have a predetermined gap W6. In this embodiment, transparent electrodes 214A and 216A are formed in a triangular shape in such a manner to have a predetermined gap W6 in a diagonal line direction within the discharge cell. In this case, the inclined plane 232 of each triangular shape transparent electrode 214A and 216A is formed in a curved shape.

In the plasma display according to the eighth embodiment of the present invention, a discharge path is increased to thereby enlarge a light-emission area with the aid of the gap 230 between the transparent electrodes 214A and 216A formed to have a predetermined gap W6 in a diagonal line direction within the discharge cell, thereby enhancing discharge efficiency as well as increasing the amount of ultraviolet rays emitted upon discharge to improve brightness. Furthermore, this plasma display can reduce an area of the transparent electrodes 214A and 216A to thereby reduce power consumption because vertical planes of the transparent electrodes 214A and 216A are formed within the discharge cell in such a manner to be spaced at a predetermined distance from the barrier rib 226.

Figure 17:
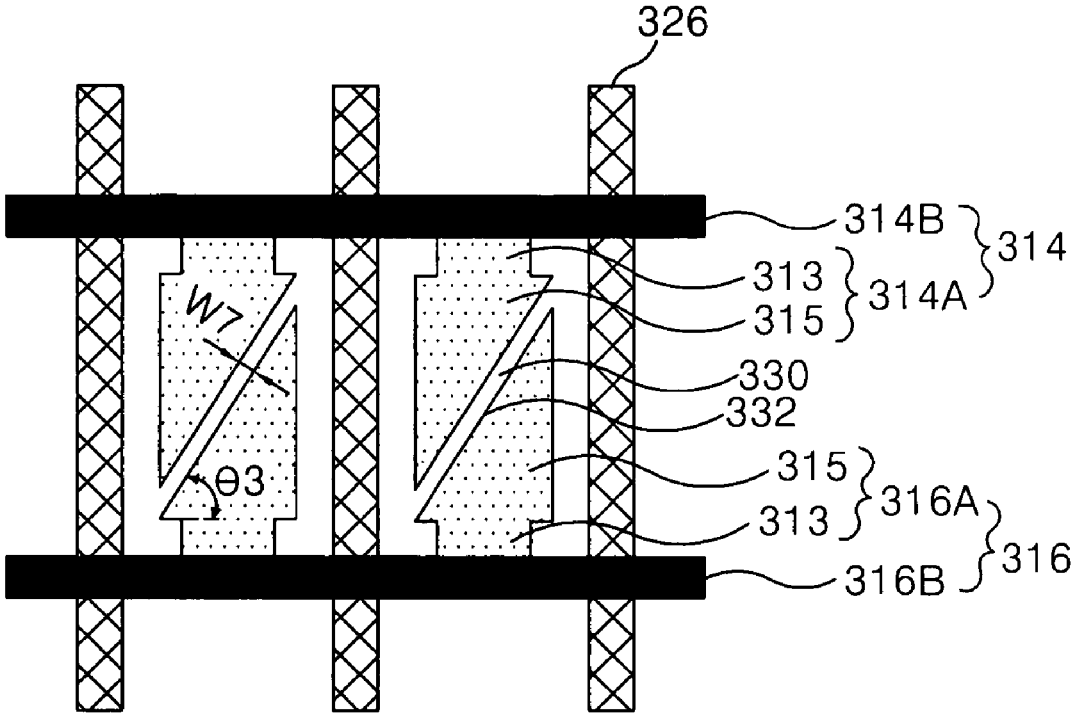
FIG. 17 is a plan view showing an electrode structure of a plasma display according to a ninth embodiment of the present invention.

Referring to FIG. 17, a plasma display according to a ninth embodiment of the present invention has the same elements as the plasma display according to the first embodiment shown in FIG. 7 except for transparent electrodes 314A and 316A. In this embodiment, transparent electrodes 314A and 316A are comprised of a neck portion 313 connected to a metal electrode 314B, and a right-triangular shape head portion 315 connected to the neck portion 313 and having a decreasing width as it goes toward the center of the discharge.

More specifically, the neck portion 313 is formed in a rectangular and is connected to each of the metal electrodes 314B and 316B. One side of the head portion 315 connected to the neck portion 313 has a larger width than the neck portion, whereas other side of the head portion 315 has a more reduced width as it goes toward other opposed transparent electrodes 314A and 316A. A vertical plane of each transparent electrode 314A and 316A is spaced at a predetermined distance from the barrier rib 326 for separating the discharge cell. The inclined plane 332 of each right-triangular shape head portion 315 is opposed to each other in such a manner to have a predetermined gap W7 in a diagonal line direction within the discharge cell. In this case, a slope θ3 of the inclined plane 332 of each head portion 315 has a range of 0° to 90°, and an optimum slope θ2 thereof has a range of 0° to 45°. Because of the inclined plane 332 of the head portion 315, the gap 330 having a predetermined distance W4 is formed in a diagonal line direction within the discharge cell. An electric field concentrates on the corner of each head portion 315 upon discharge to thereby raise a discharge at an edge area of the discharge cell.

In the plasma display according to the ninth embodiment of the present invention, a discharge path is increased to thereby enlarge a light-emission area with the aid of the gap 330 between the transparent electrodes 314A and 316A formed to have a predetermined gap W7 in a diagonal line direction within the discharge cell, thereby enhancing discharge efficiency as well as increasing the amount of ultraviolet rays emitted upon discharge to thereby improve brightness. Also, this plasma display can reduce an area of the transparent electrodes 314A and 316A to thereby reduce power consumption because vertical planes of the transparent electrodes 314A and 316A are formed within the discharge cell in such a manner to be spaced at a predetermined distance from the barrier rib 326.

Figure 18:
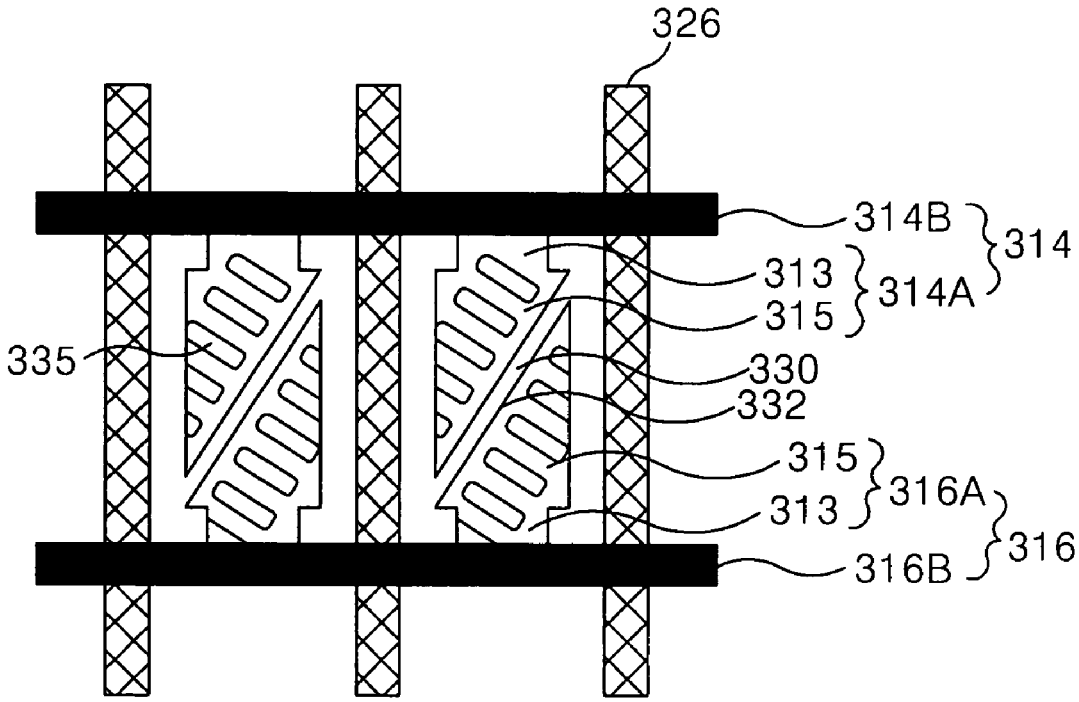
FIG. 18 is a plan view showing an electrode structure of a plasma display according to a tenth embodiment of the present invention.

Referring to FIG. 18, a plasma display according to a tenth embodiment of the present invention has the same elements as the plasma display according to the ninth embodiment shown in FIG. 17, except for a hole 335 formed at each head portion 315 of transparent electrodes 314A and 316A. In this embodiment, holes 335 are formed in a circular, square or polygonal shape at the right-triangular shape transparent electrodes 314A and 316A to thereby reduce an area of the head portion 315. Thus, in the plasma display according to the tenth embodiment of the present invention, capacitance values of the transparent electrodes 314A and 316A are reduced and hence power consumption is reduced. Moreover, an electrode area of the sustain electrode pair 314 and 316 can be reduced to thereby increase an aperture ratio.

Furthermore, a discharge path is increased to thereby enlarge a light-emission area with the aid of the gap 330 between the transparent electrodes 314A and 316A formed to have a predetermined gap W7 in a diagonal line direction within the discharge cell, thereby enhancing discharge efficiency as well as increasing the amount of ultraviolet rays emitted upon discharge to thereby improve brightness. Also, the plasma display according to the tenth embodiment of the present invention can reduce an area of the transparent electrodes 314A and 316A to thereby reduce power consumption because vertical planes of the transparent electrodes 314A and 316A are formed within the discharge cell in such a manner to be spaced at a predetermined distance from the barrier rib 326.

Figure 19:
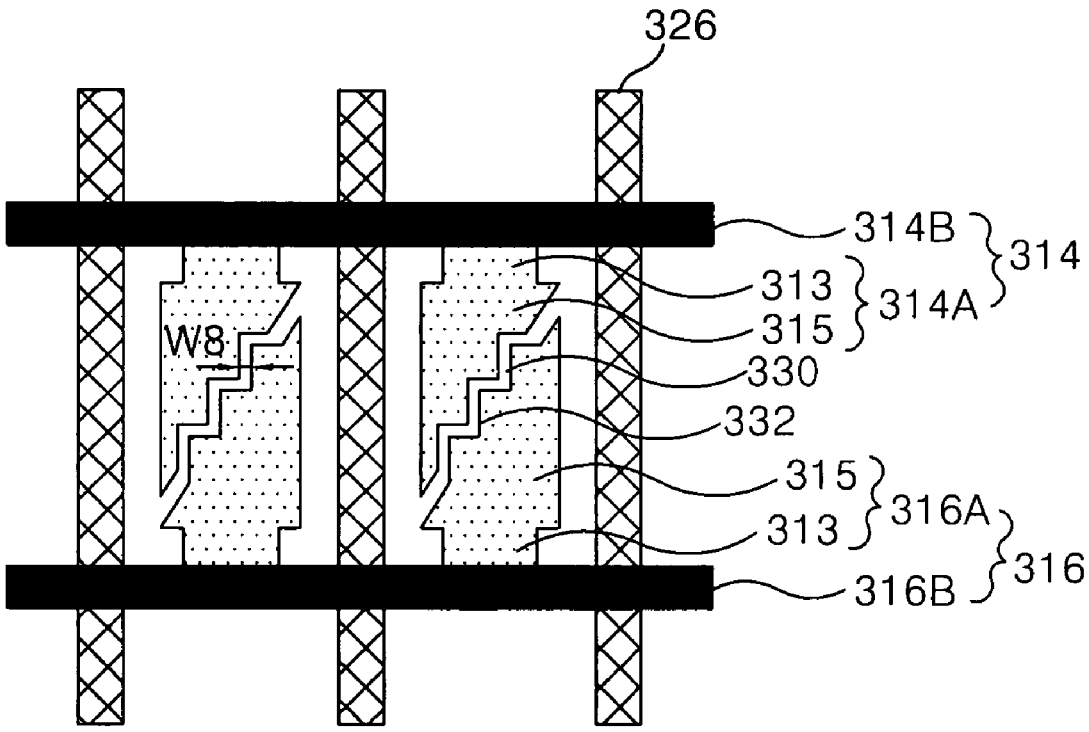
FIG. 19 is a plan view showing an electrode structure of a plasma display according to an eleventh embodiment of the present invention.

Referring to FIG. 19, a plasma display according to an eleventh embodiment of the present invention has the same elements as the plasma display according to the ninth embodiment shown in FIG. 17, except for a shape of the inclined plane 332 of each transparent electrode 314A and 316A opposed to each other in such a manner to have a predetermined gap W8. In this embodiment, transparent electrodes 314A and 316A are formed in a triangular shape in such a manner to have a predetermined gap W8 in a diagonal line direction within the discharge cell. In this case, the inclined plane 332 of each triangular shape transparent electrode 314A and 316A is formed in a stepwise shape. Accordingly, an electric field concentrates on each stepwise corner upon discharge between the transparent electrodes 314A and 316A to thereby raise a discharge at the edge area of the discharge cell.

In the plasma display according to the eleventh embodiment of the present invention, a discharge path is increased to thereby enlarge a light-emission area with the aid of the gap 330 between the transparent electrodes 314A and 316A formed to have a predetermined gap W8 in a diagonal line direction within the discharge cell, thereby enhancing discharge efficiency as well as increasing the amount of ultraviolet rays emitted upon discharge to thereby improve brightness. Also, the plasma display can reduce an area of the transparent electrodes 314A and 316A to thereby reduce power consumption, because vertical planes of the transparent electrodes 314A and 316A are formed within the discharge cell in such a manner to be spaced at a predetermined distance from the barrier rib 326.

Figure 20:
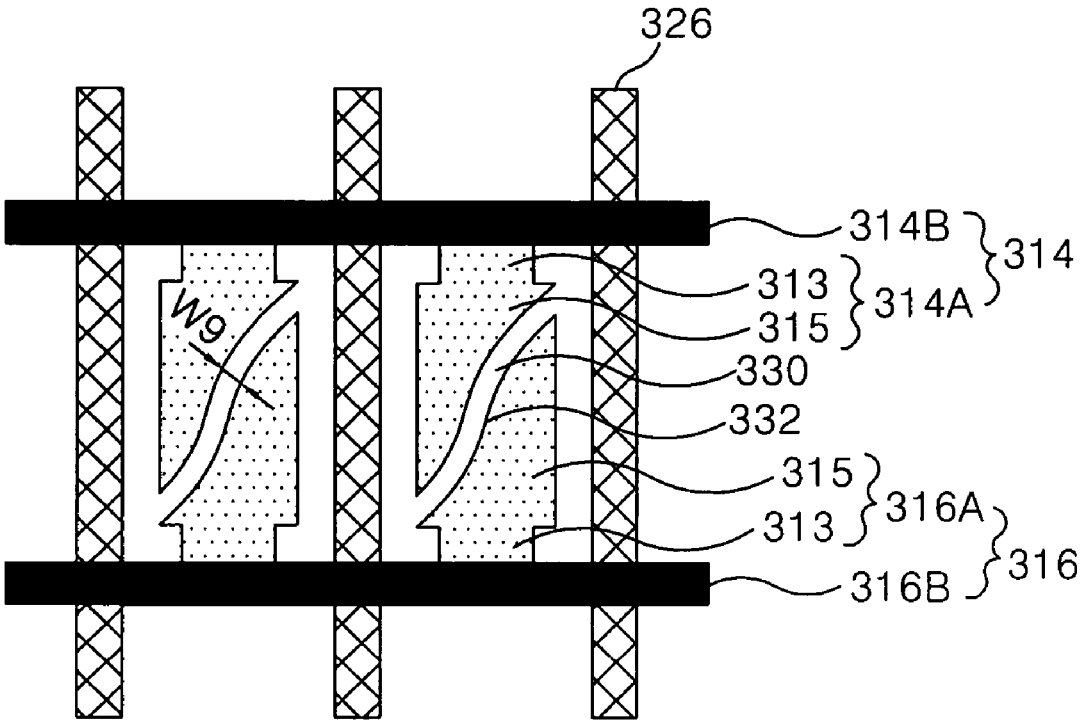
FIG. 20 is a plan view showing an electrode structure of a plasma display according to a twelfth embodiment of the present invention.

Referring to FIG. 20, a plasma display according to a twelfth embodiment of the present invention has the same elements as the plasma display according to the ninth embodiment shown in FIG. 17, except for a shape of the inclined plane 332 of each transparent electrode 314A and 316A opposed to each other in such a manner to have a predetermined gap W9. In this embodiment, transparent electrodes 314A and 316A are formed in a triangular shape in such a manner to have a predetermined gap W9 in a diagonal line direction within the discharge cell. In this case, the inclined plane 332 of each triangular shape transparent electrode 314A and 316A is formed in a curve shape.

In the plasma display according to the twelfth embodiment of the present invention, a discharge path is increased to thereby enlarge a light-emission area with the aid of the gap 330 between the transparent electrodes 314A and 316A formed to have a predetermined gap W9 in a diagonal line direction within the discharge cell, thereby enhancing discharge efficiency as well as increasing an emission amount of ultraviolet rays upon discharge to thereby improve brightness. Also, the plasma display can reduce an area of the transparent electrodes 314A and 316A to thereby reduce power consumption because vertical planes of the transparent electrodes 314A and 316A are formed within the discharge cell in such a manner to be spaced at a predetermined distance from the barrier rib 326.

Figure 1:
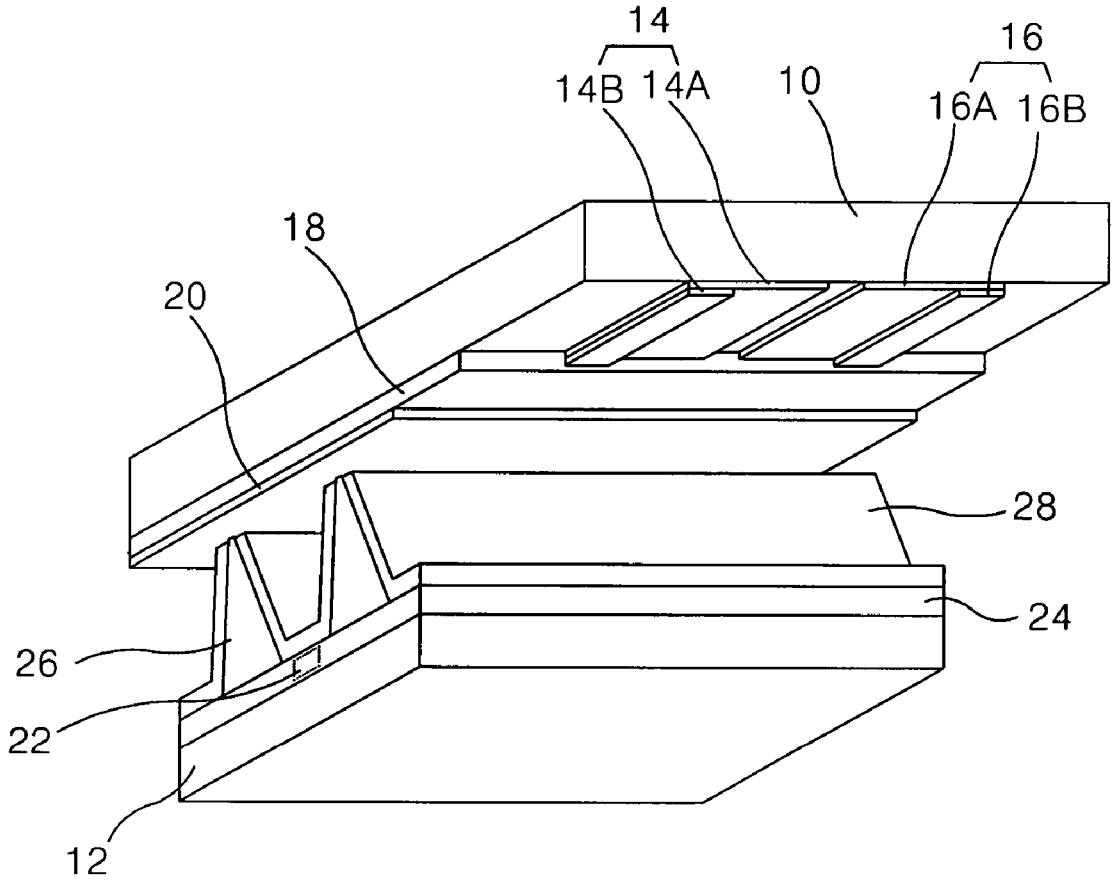
FIG. 1 RELATED ART
FIG. 1 is a perspective view showing a discharge cell structure of a related-art three-electrode, AC surface-discharge plasma display.
Figure 2:
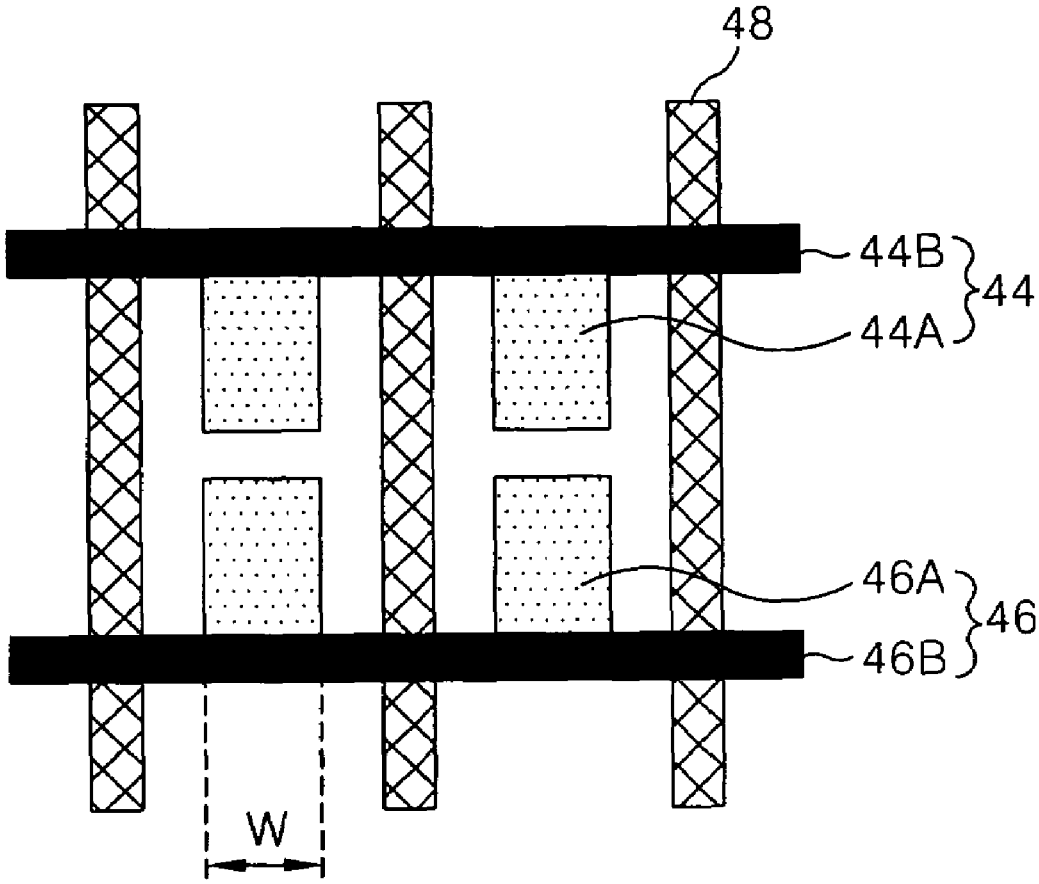
FIG. 2 RELATED ART
FIG. 2 is a plan view showing another electrode structure of related-art plasma display.
Figure 3:
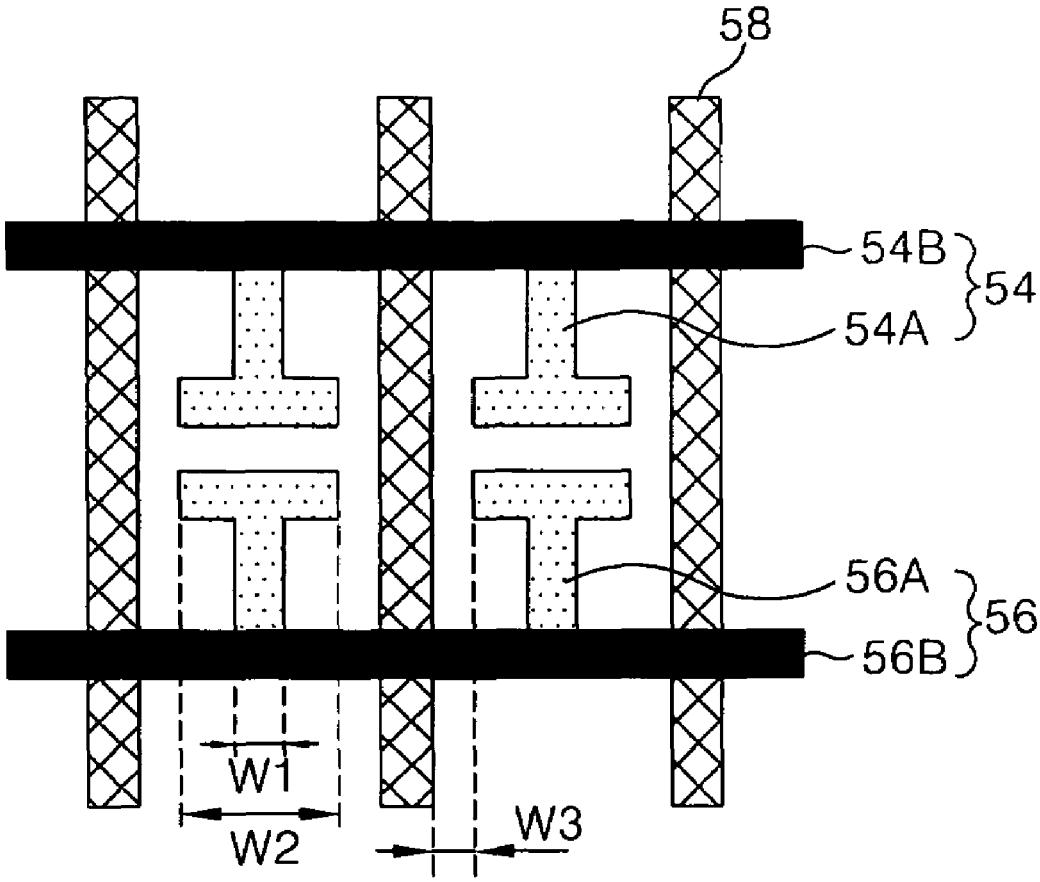
FIG. 3 RELATED ART
FIG. 3 is a plan view showing an electrode structure of another related-art plasma display which improves upon the electrode structure of FIG. 2.
Figure 4:
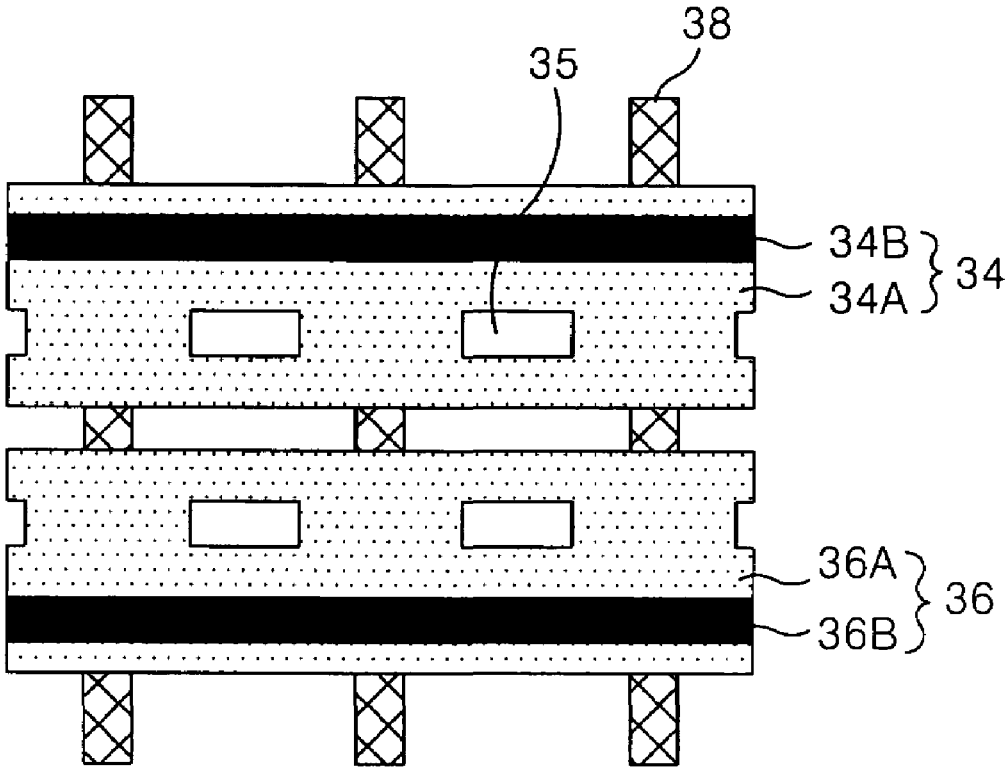
FIG. 4 RELATED ART
FIG. 4 is a plan view showing another electrode structure of a related-art plasma display.
Figure 5:
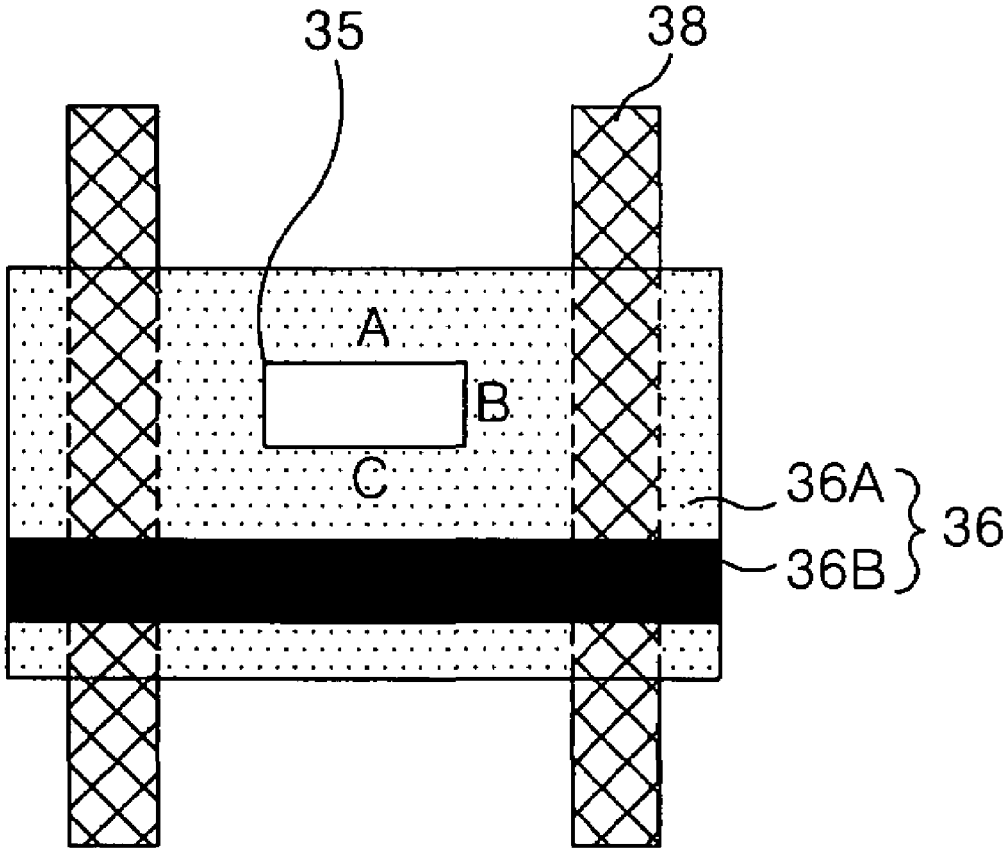
FIG. 5 RELATED ART
FIG. 5 depicts a discharge phenomenon in the plasma display shown in FIG. 4.
Figure 6:
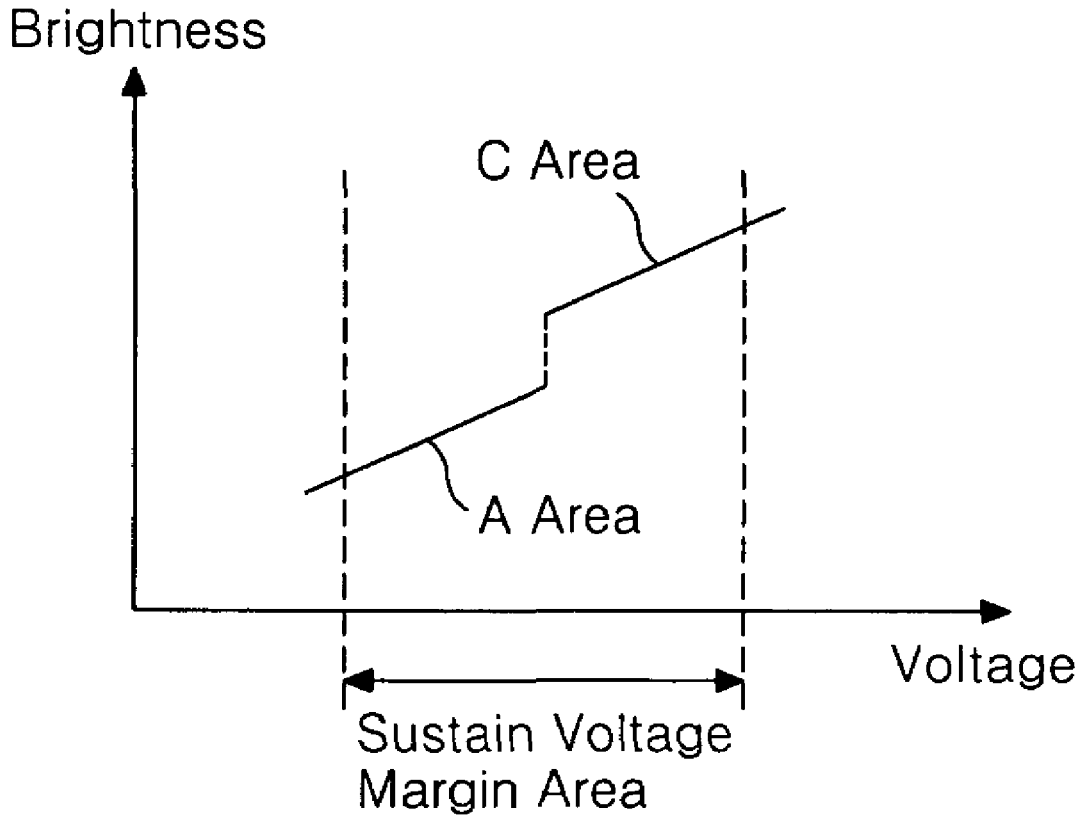
FIG. 6 RELATED ART
FIG. 6 is a graph showing a discharge generated at the discharge cell of the related-art plasma display.
Figure 21:
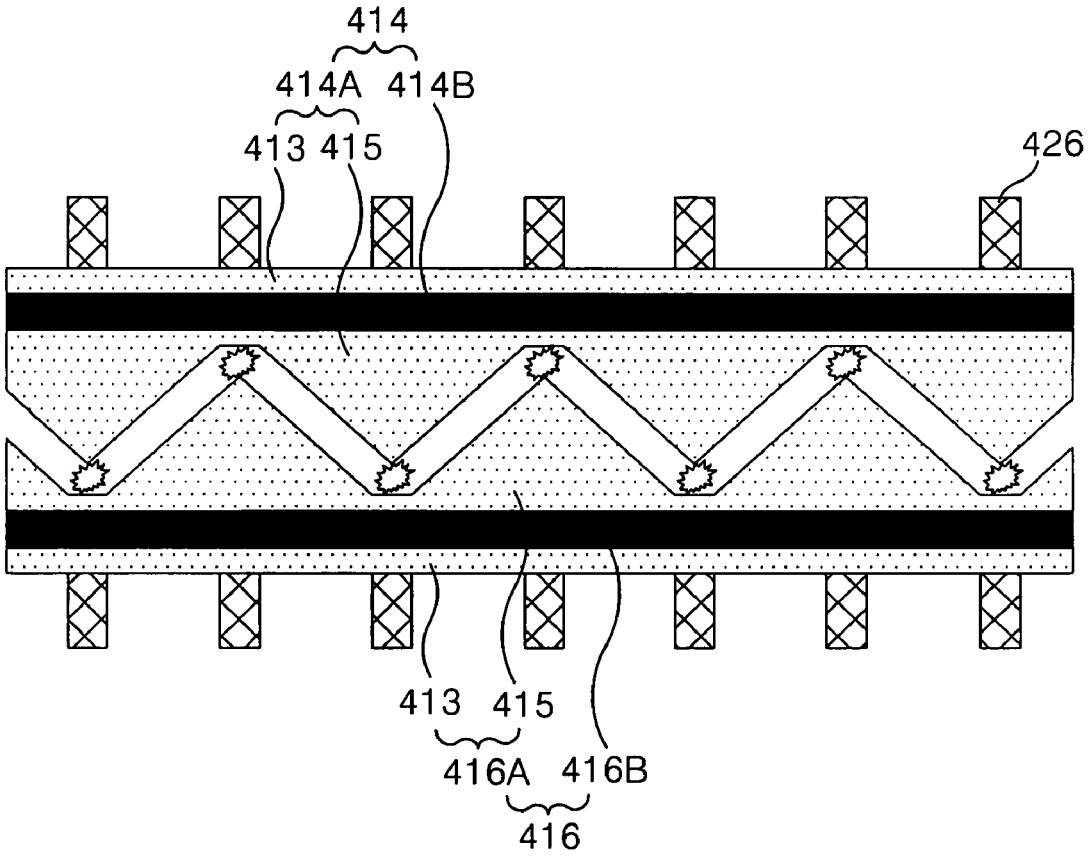
FIG. 21 is a plan view showing an electrode structure of a plasma display according to a thirteenth embodiment of the present invention.

Referring to FIG. 21, a plasma display according to a thirteenth embodiment of the present invention has the same elements as the plasma display according to the first embodiment shown in FIG. 1 except for a sustain electrode pair 414 and 416. In this embodiment, the sustain electrode pair 414 and 416 is comprised of a portion 413 formed from a transparent electrode material in a stripe shape, first and second transparent electrodes 414A and 416A having a head 415 expanded in a triangular shape from the stripe portion 413, and first and second metal electrodes 414B and 416B formed on the stripe portion 413 and having a relatively smaller width than the stripe portion.

Such a sustain electrode pair 414 and 416 consists of a scan electrode 414 and a sustain electrode 416. The scan electrode 414 is mainly supplied with a scan signal for a panel scanning and a sustain signal for a discharge sustaining, whereas the sustain electrode 416 is mainly supplied with a sustain signal.

The stripe part 413 of each of the first and second transparent electrodes 414A and 416A has a relatively large width and is made from a transparent electrode material such as ITO for the purpose of transmitting a visible light. Further, the stripe portion 413 crosses the barrier ribs 426 for separating adjacent discharge cells.

The head portion 415 of the first transparent electrode 414A is formed in a triangular shape that has a smaller width as it goes closer to the metal electrode 416B of the sustain electrode 416 and makes a peak on the barrier rib 426. The head portion 415 of the first transparent electrode 414A is formed between adjacent discharge cells in a triangular shape whose apex is positioned on the barrier rib 426 separating adjacent discharge cells.

The head portion 415 of each of the first and second transparent electrodes 414A and 416A is arranged in a zigzag within the discharge cell. Thus, the heads portion 415 of the first and second transparent electrodes 414A and 416A are opposed to each other in such a manner to have a predetermined gap in a diagonal line direction. As a result, the predetermined gap within the discharge cell is formed in a zigzag.

Accordingly, the head portion 415 of the first transparent electrode 414A and the head portion 415 of the second transparent electrode 416A are formed in a triangular shape in such a manner to cross each other, thereby narrowing a distance between the first transparent electrode 414A and the second metal electrode 416B and a distance between the second transparent electrode 416A and the first metal electrode 414B and enlarging an opposed area of the first transparent electrode 414A and the second transparent electrode 416A.

In the plasma display according to the thirteenth embodiment of the present invention, if a sustaining voltage is applied to the metal electrode 414B of the scan electrode 414 and the metal electrode 416B of the sustain electrode 416, then an initial discharge is generated at the head portion 415 of the second transparent electrode 416A corresponding to a portion making the closest apex between the head portion 415 of the first transparent electrode 414A and the head portion 415 of the second transparent electrode 416A, i.e., a corner portion making an apex from the head portion 415 of the first transparent electrode 414A. At the same time, a discharge is generated at the head portion 415 of the first transparent electrode 414A corresponding to a portion making the closest apex between the head portion 415 of the second transparent electrode 416A and the head portion 415 of the first transparent electrode 414A. That is, a corner portion making an apex from the head portion 415 of the second transparent electrode 416A.

Subsequently, as a sustaining voltage is continuously applied to each of the first and second metal electrodes 414B and 416B, a discharge is expanded into all opposed portions of the first and second transparent electrodes 414A and 416A and thus is diffused into the entire discharge cell.

As described above, the plasma display according to the thirteenth embodiment of the present invention shortly form lengths of the first and second transparent electrodes 414A and 416A at one side thereof upon initial discharge, thereby reducing a power loss caused by resistance of the first and second transparent electrodes 414A and 416A as much as possible. Furthermore, this plasma display shortly forms lengths of the first and second transparent electrodes 414A and 416A at one side thereof upon initial discharge, thereby causing a fast initial discharge and thus improving discharge efficiency.

Figure 22:
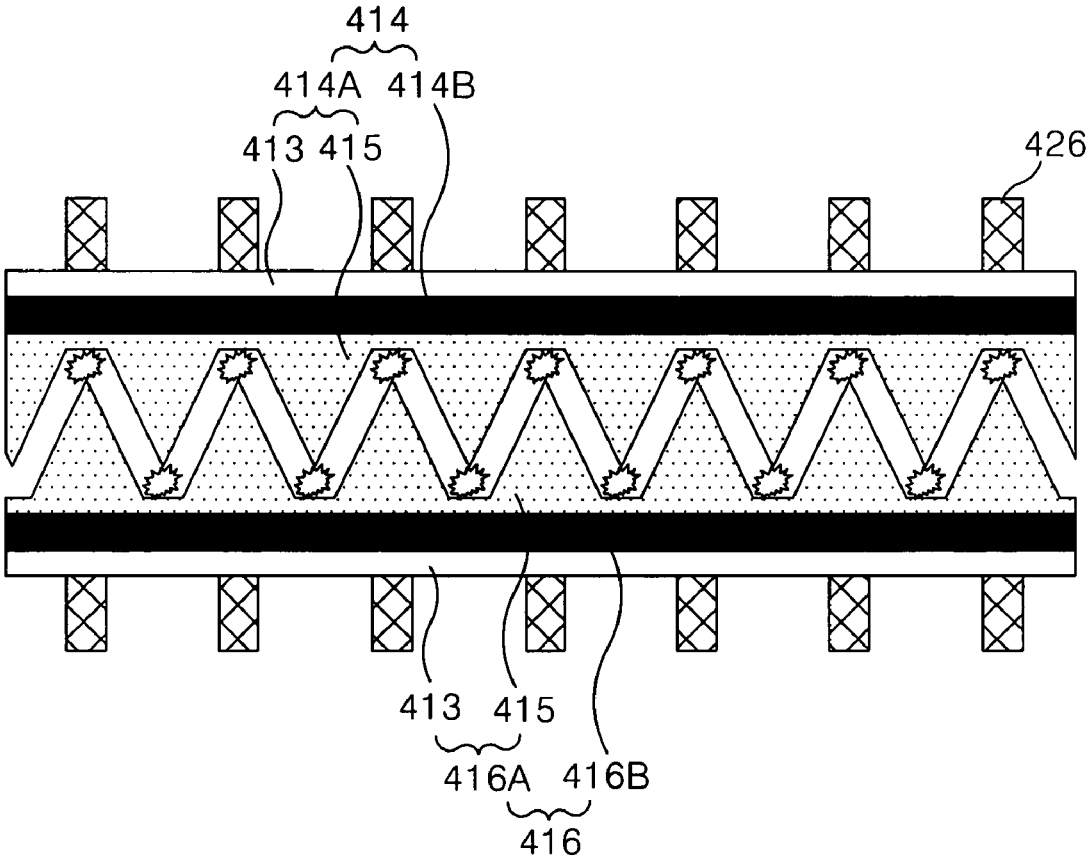
FIG. 22 is a plan view showing an electrode structure of a plasma display according to a fourteenth embodiment of the present invention.

Referring to FIG. 22, a plasma display according to a fourteenth embodiment of the present invention has the same elements as the plasma display according to the thirteenth embodiment shown in FIG. 21, except for a hole 435 formed at each head portion 415 of transparent electrodes 414A and 416A. Holes 435 are formed in a circular, square or polygonal shape at the triangular shape head portion 415 to thereby reduce an area of the head portion 415. Thus, in the plasma display according to the fourteenth embodiment of the present invention, capacitance values of the transparent electrodes 414A and 416A are reduced and hence power consumption is reduced. Moreover, an electrode area of the sustain electrode pair 414 and 416 can be reduced to thereby increase an aperture ratio.

Furthermore, a discharge path is increased to thereby enlarge a light-emission area with the aid of the gap between the transparent electrodes 414A and 416A formed to have a predetermined gap in a diagonal line direction within the discharge cell, thereby enhancing discharge efficiency as well as increasing the amount of ultraviolet rays emitted upon discharge to thereby improve brightness.

Meanwhile, the plasma display according to the fourteenth embodiment of the present invention shortly form lengths of the first and second transparent electrodes 414A and 416A at one side thereof upon initial discharge, thereby reduce a power loss caused by resistance of the first and second transparent electrodes 414A and 416A as much as possible. Furthermore, shortly form lengths of the first and second transparent electrodes 414A and 416A at one side thereof upon initial discharge, thereby causing a fast initial discharge and thus improving discharge efficiency and brightness.

Figure 23:
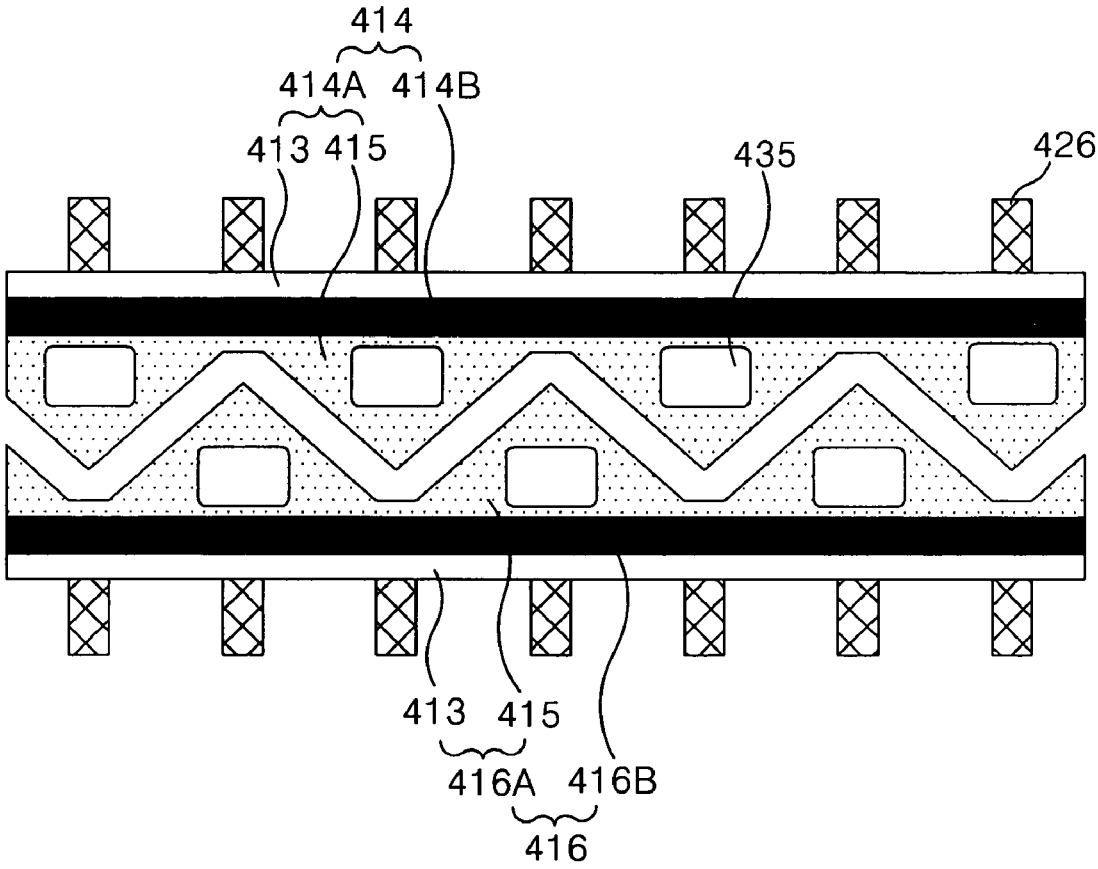
FIG. 23 is a plan view showing an electrode structure of a plasma display according to a fifteenth embodiment of the present invention.

Referring to FIG. 23, a plasma display according to a fifteenth embodiment of the present invention has the same elements as the plasma display according to the thirteenth embodiment shown in FIG. 21 except for a sustain electrode pair 414 and 416. In this embodiment, the sustain electrode pair 414 and 416 is comprised of a portion 413 formed from a transparent electrode material in a stripe shape, first and second transparent electrodes 414A and 416A having a head 415 expanded in a triangular shape from the stripe portion 413, and first and second metal electrodes 414B and 416B formed on the stripe portion 413 and having a relatively smaller width than the stripe portion 413.

Such a sustain electrode pair 414 and 416 consists of a scan electrode 414 and a sustain electrode 416. The scan electrode 414 is mainly supplied with a scan signal for a panel scanning and a sustain signal for a discharge sustaining, whereas the sustain electrode 416 is mainly supplied with a sustain signal.

The stripe portion 413 of each of the first and second transparent electrodes 414A and 416A has a relatively large width and is made from a transparent electrode material such as ITO for the purpose of transmitting a visible light. Further, the stripe portion 413 crosses the barrier ribs 426 for separating adjacent discharge cells.

The head portion 415 of the first transparent electrode 414A is formed in a triangular shape that has a smaller width as it goes closer to the metal electrode 416B of the sustain electrode 416 and makes a peak on the barrier rib 426. The head portion 415 of the first transparent electrode 414A is formed within the discharge cell in a triangular shape whose apex is positioned at an area adjacent to the stripe portion 413 of the second transparent electrode 416A.

The head portion 415 of the second transparent electrode 416A crosses the head portion 415 of the first transparent electrode 414A, and is formed in a triangular shape that has a smaller width as it goes closer to the metal electrode 414B of the scan electrode 414 and makes an apex on the barrier rib 426. The head portion 415 of the second transparent electrode 416A is formed within the discharge cell in a triangular shape whose apex is positioned on the barrier rib 426. Thus, a portion making an apex between the respective heads portion 415 of the first and second transparent electrodes 414A and 416A becomes more than two positions within a single of discharge cell.

The head portion 415 of each of the first and second transparent electrodes 414A and 416A is arranged in a zigzag within the discharge cell. Thus, the heads portion 415 of the first and second transparent electrodes 414A and 416A are opposed to each other in such a manner to have a predetermined gap in a diagonal line direction. As a result, the predetermined gap within the discharge cell is formed in a zigzag.

Accordingly, the head portion 415 of the first transparent electrode 414A and the head portion 415 of the second transparent electrode 416A are formed in a triangular shape in such a manner to cross each other, thereby narrowing a distance between the first transparent electrode 414A and the second metal electrode 416B and a distance between the second transparent electrode 416A and the first metal electrode 414B and enlarging an opposed area of the first transparent electrode 414A and the second transparent electrode 416A.

In the plasma display according to the fifteenth embodiment, if a sustaining voltage is applied to the metal electrode 414B of the scan electrode 414 and the metal electrode 416B of the sustain electrode 416, then an initial discharge is generated at the head portion 415 of the second transparent electrode 416A corresponding to a portion making the closest apex between the head portion 415 of the first transparent electrode 414A and the head portion 415 of the second transparent electrode 416A, i.e., a corner portion making an apex from the head portion 415 of the first transparent electrode 414A. At the same time, a discharge is generated at the head portion 415 of the first transparent electrode 414A corresponding to a portion making the closest apex between the head portion 415 of the second transparent electrode 416A and the head portion 415 of the first transparent electrode 414A, i.e., a plurality of corner portions making an apex from the head portion 415 of the second transparent electrode 416A on the barrier rib 426.

Subsequently, as a sustaining voltage is continuously applied to each of the first and second metal electrodes 414B and 416B, a plurality of initial discharges are expanded into all opposed portions of the first and second transparent electrodes 414A and 416A and thus is diffused into the entire discharge cell.

As described above, the plasma display shortly forms lengths of the first and second transparent electrodes 414A and 416A at one side thereof upon initial discharge, thereby reduce a power loss caused by resistance of the first and second transparent electrodes 414A and 416A as much as possible. Furthermore, the plasma display according to the fifteenth embodiment of the present invention shortly form lengths of the first and second transparent electrodes 414A and 416A at one side thereof upon initial discharge, thereby causing a plurality of fast initial discharges and thus improving discharge efficiency and brightness.

Figure 24:
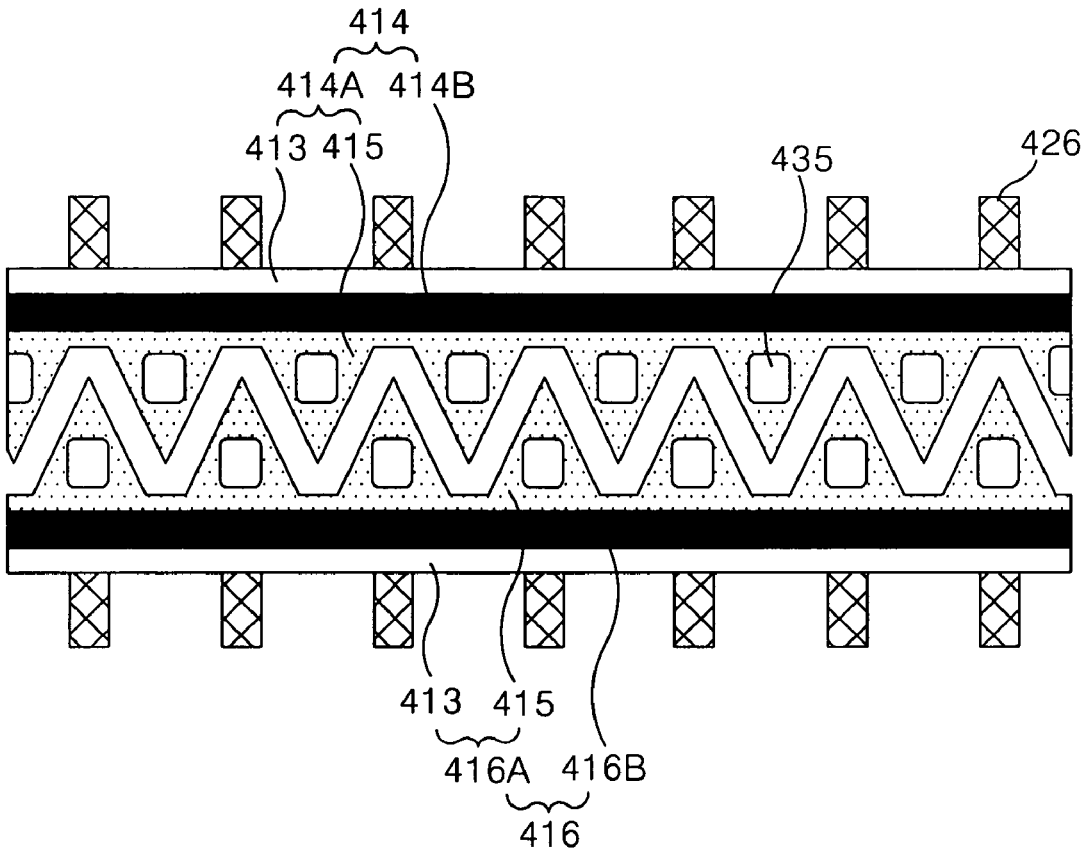
FIG. 24 is a plan view showing an electrode structure of a plasma display according to a sixteenth embodiment of the present invention.

Referring to FIG. 24, a plasma display according to the sixteenth embodiment of the present invention has the same elements as the plasma display according to the fifteenth embodiment shown in FIG. 23 except for a hole 435 formed at each head portion 415 of transparent electrodes 414A and 416A. Holes 435 are formed in a circular, square or polygonal shape at the triangular shape head portion 415 to thereby reduce an area of the head portion 415. Thus, in the plasma display according to the sixteenth embodiment of the present invention, capacitance values of the transparent electrodes 414A and 416A are reduced and hence power consumption is reduced. Moreover, an electrode area of the sustain electrode pair 414 and 416 can be reduced to thereby increase an aperture ratio.

Furthermore, a discharge path is increased to thereby enlarge a light-emission area with the aid of the gap between the transparent electrodes 414A and 416A formed to have a predetermined gap in a diagonal line direction within the discharge cell, thereby enhancing discharge efficiency as well as increasing an emission amount of ultraviolet rays upon discharge to thereby improve brightness.

Meanwhile, the plasma display according to the sixteenth embodiment of the present invention shortly forms lengths of the first and second transparent electrodes 414A and 416A at one side thereof upon initial discharge, thereby reduce a power loss caused by resistance of the first and second transparent electrodes 414A and 416A as much as possible. Furthermore, the plasma display shortly forms lengths of the first and second transparent electrodes 414A and 416A at one side thereof upon initial discharge, thereby causing a plurality of fast initial discharges and thus improving discharge efficiency and brightness.

As described above, a plasma display according to the present invention forms the polygonal, stepwise or curved inclined planes of the triangular shape transparent electrodes oppositely in such a manner or to have a predetermined gap in a diagonal line direction within the discharge cell. This activates a discharge at the non-discharge area and increases a discharge at the edge area of the discharge cell, so that discharge efficiency can be improved and a discharge path upon discharge is increased to thereby enlarge a light-emission area and thus improve brightness.

Furthermore, the plasma display according to the present invention forms the polygonal, stepwise or curve inclined planes of the triangular shape transparent electrodes oppositely in such a manner or to have a predetermined gap in a diagonal line direction within the discharge cell, and at the same time form holes in the transparent electrodes, thereby improving an aperture ratio as well as reducing power consumption.

The plasma display according to the present invention also forms the triangular shape transparent electrodes in such a manner or to cross each other within the discharge cell, thereby reducing a power loss caused by a resistance and causing a fast initial discharge to thereby improve initial discharge efficiency. Moreover, the plasma display according to the present invention enlarges an area causing a discharge, thereby improving discharge efficiency and brightness.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display, comprising:

a pair of transparent electrodes formed in opposing relation and having a predetermined gap within a discharge cell; and metal electrodes connected to respective ones of the transparent electrodes, wherein said gap is formed in a diagonal direction within the discharge cell.

2. The plasma display of claim 1, wherein the transparent electrode pair is formed in a triangular shape within the discharge cell.

3. The plasma display of claim 2, wherein each of the transparent electrodes has an inclined plane in a range of 0° to 90°.

4. The plasma display of claim 3, wherein said inclined planes of the transparent electrodes are opposed to each other in such a manner to have said gap in a diagonal direction within the discharge cell.

5. The plasma display of claim 3, wherein the inclined plane of each transparent electrode is formed in one of a stepwise shape and a curved shape.

6. The plasma display of claim 1, further comprising:

a plurality of holes formed in the transparent electrodes.

7. The plasma display of claim 1, wherein the pair of transparent electrodes is spaced a predetermined distance from the barrier rib and is formed in a triangular shape within the discharge cell in such a manner to have said gap.

8. The plasma display of claim 7, wherein each of the transparent electrode has an inclined plane in a range of 0° to 90°.

9. The plasma display of claim 8, wherein the inclined planes of the transparent electrodes are opposed to each other in such a manner to have said gap in a diagonal direction within the discharge cell.

10. The plasma display of claim 8, wherein said inclined plane is formed in one of a stepwise shape and a curved shape.

11. The plasma display of claim 7, further comprising:

a plurality of holes formed in the transparent electrodes.

12. The plasma display of claim 1, wherein each of the transparent electrodes includes:

a neck portion connected to the metal electrode; and a head portion formed in a triangular shape from the neck portion.

13. The plasma display of claim 12, wherein the head portion has an inclined plane in a range of 0° to 90°.

14. The plasma display of claim 13, wherein one side of the head portion connected to the neck portion has a larger width than the neck portion, and another side of the head portion has a decreasing width to form said inclined plane.

15. The plasma display of claim 14, wherein the inclined planes of the transparent electrodes are opposed to each other in such a manner to have said gap in a diagonal direction within the discharge cell.

16. The plasma display of claim 13, wherein the inclined plane is formed in one of a stepwise shape and a curved shape.

17. The plasma display of claim 12, further comprising:

a plurality of holes formed in the head portion.

18. The plasma display of claim 1, wherein the transparent electrode pair includes a first transparent electrode and a second transparent electrode, and wherein each of the first and the second transparent electrodes has:

a stripe portion connected in such a manner to cross the metal electrode; and a head portion formed in a triangular shape in such a manner to have said gap from the stripe portion.

19. The plasma display of claim 18, wherein an apex of the head portion in a triangular shape is formed on the barrier rib for separating the adjacent discharge cells.

20. The plasma display of claim 18, wherein said gap is formed in a zigzag pattern.

21. The plasma display of claim 18, further comprising:

a plurality of holes formed in the head portion.

22. The plasma display of claim 18, wherein an apex of the head portion of one of the transparent electrodes is formed on the barrier rib for separating the adjacent discharge cells, and an apex of the head portion of the other one of the transparent electrodes is formed within the discharge cell.

23. The plasma display of claim 22, wherein said apex of the head portion of the first transparent electrode is formed on the barrier rib in such a manner to have said gap from the stripe portion of second transparent electrode.

24. The plasma display of claim 22, wherein said apex of the head portion of the second transparent electrode is formed at a center of the discharge cell in such a manner to have said gap from the stripe portion of first transparent electrode.

25. The plasma display of claim 22, wherein said gap is formed in a zigzag pattern.

26. The plasma display of claim 22, further comprising:

a plurality of holes formed in the head portion.

* * * * *